US010871036B2

(12) United States Patent
Zahradnik et al.

(10) Patent No.: US 10,871,036 B2
(45) Date of Patent: Dec. 22, 2020

(54) HYBRID DRILL BIT AND DESIGN METHOD

(71) Applicant: Baker Hughes Holdings LLC, Houston, TX (US)

(72) Inventors: Anton F. Zahradnik, Sugar Land, TX (US); Rudolf Carl Pessier, Houston, TX (US); Don Q. Nguyen, Houston, TX (US); Matthew J. Meiners, Conroe, TX (US); Karlos B. Cepeda, Houston, TX (US); Michael S. Damschen, Houston, TX (US); Mark P. Blackman, Spring, TX (US); Jack T. Oldham, Conroe, TX (US); Ronny D. McCormick, Magnolia, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

(21) Appl. No.: 16/417,079

(22) Filed: May 20, 2019

(65) Prior Publication Data

US 2019/0352971 A1 Nov. 21, 2019

Related U.S. Application Data

(60) Division of application No. 14/223,322, filed on Mar. 24, 2014, now Pat. No. 10,316,589, which is a (Continued)

(51) Int. Cl.
*E21B 10/08* (2006.01)
*E21B 10/16* (2006.01)
(Continued)

(52) U.S. Cl.
CPC ..... *E21B 10/14* (2013.01); *E21B 10/08* (2013.01); *E21B 10/16* (2013.01); *E21B 10/42* (2013.01); *E21B 10/43* (2013.01)

(58) Field of Classification Search
CPC ..... E21B 10/08; E21B 10/16; E21B 10/425; E21B 10/43
See application file for complete search history.

(56) References Cited

U.S. PATENT DOCUMENTS 930,759 A 8/1909 Hughes
1,388,424 A 8/1921 George
(Continued)

FOREIGN PATENT DOCUMENTS

DE 1301784 B 8/1969
DE 4301784 8/1969
(Continued)

OTHER PUBLICATIONS

B. George, E. Grayson, R. Lays, F. Felderhoff, M. Doster and M. Holmes. "Significant Cost Savings Achieved Through the Use of PDC Bits in Compressed Air/Foam Applications." Society of Petroleum Engineers—SPE 116118, 2008 SPC Annual Technical Conference and Exhibition, Denver, Colorado, Sep. 21-24, 2008.
(Continued)

*Primary Examiner* — Cathleen R Hutchins
(74) *Attorney, Agent, or Firm* — TraskBritt

(57) ABSTRACT

A hybrid earth-boring bit comprising a bit body having a central axis, at least one, preferably three fixed blades, depending downwardly from the bit body, each fixed blade having a leading edge, and at least one rolling cutter, preferably three rolling cutters, mounted for rotation on the bit body. A rolling cutter is located between two fixed blades.

16 Claims, 12 Drawing Sheets

Related U.S. Application Data continuation of application No. 12/271,033, filed on Nov. 14, 2008, now Pat. No. 8,678,111.

(60) Provisional application No. 60/988,718, filed on Nov. 16, 2007.

(51) Int. Cl.

| | |
|---|---|
| ***E21B 10/43*** | (2006.01) |
| ***E21B 10/14*** | (2006.01) |
| ***E21B 10/42*** | (2006.01) |

(56) References Cited

U.S. PATENT DOCUMENTS

| | | | |
|---|---|---|---|
| 1,394,769 | A | 10/1921 | Sorensen |
| 1,519,641 | A | 12/1924 | Thompson |
| 1,537,550 | A | 5/1925 | Reed |
| 1,729,062 | A | 9/1929 | Bull |
| 1,801,720 | A | 4/1931 | Bull |
| 1,816,568 | A | 7/1931 | Carlson |
| 1,821,474 | A | 9/1931 | Mercer |
| 1,874,066 | A | 8/1932 | Scott et al. |
| 1,879,127 | A | 9/1932 | Schlumpf |
| 1,896,243 | A | 2/1933 | MacDonald |
| 1,932,487 | A | 10/1933 | Scott |
| 2,030,722 | A | 2/1936 | Scott |
| 2,089,187 | A | 8/1937 | Camille et al. |
| 2,117,481 | A | 5/1938 | Howard et al. |
| 2,119,618 | A | 6/1938 | Zublin |
| 2,184,067 | A | 12/1939 | Zublin |
| 2,198,849 | A | 4/1940 | Waxler |
| 2,204,657 | A | 6/1940 | Brendel |
| 2,216,894 | A | 10/1940 | Stancliff |
| 2,244,537 | A | 6/1941 | Kammerer |
| 2,297,157 | A | 9/1942 | McClinton |
| 2,318,370 | A | 5/1943 | Burch |
| 2,320,136 | A | 5/1943 | Kammerer |
| 2,320,137 | A | 5/1943 | Kammerer |
| 2,358,642 | A | 9/1944 | Kammerer |
| 2,380,112 | A | 7/1945 | Wellington |
| 2,520,517 | A | 8/1950 | Taylor |
| 2,533,258 | A | 12/1950 | Morlan et al. |
| 2,533,259 | A | 12/1950 | Woods et al. |
| 2,557,302 | A | 6/1951 | Maydew |
| RE23,416 | E | 10/1951 | Kinnear |
| 2,575,438 | A | 11/1951 | Alexander et al. |
| 2,628,821 | A | 2/1953 | Henry et al. |
| 2,661,931 | A | 12/1953 | Swart |
| 2,719,026 | A | 9/1955 | Boice |
| 2,725,215 | A | 11/1955 | MacNeir |
| 2,815,932 | A | 12/1957 | Wolfram |
| 2,994,389 | A | 8/1961 | Bus, Sr. |
| 3,010,708 | A | 11/1961 | Hlinsky et al. |
| 3,039,503 | A | 6/1962 | Mainone |
| 3,050,293 | A | 8/1962 | Hlinsky et al. |
| 3,055,443 | A | 9/1962 | Edwards |
| 3,066,749 | A | 12/1962 | Hildebrandt |
| 3,126,066 | A | 3/1964 | Williams, Jr. |
| 3,126,067 | A | 3/1964 | Schumacher, Jr. |
| 3,174,564 | A | 3/1965 | Morlan |
| 3,239,431 | A | 3/1966 | Knapp |
| 3,250,337 | A | 5/1966 | Demo |
| 3,269,469 | A | 8/1966 | Kelly, Jr. |
| 3,387,673 | A | 6/1968 | Thompson |
| 3,397,751 | A | 8/1968 | Reichmuth |
| 3,424,258 | A | 1/1969 | Yoshihiro |
| 3,583,501 | A | 6/1971 | Aalund |
| 3,760,894 | A | 9/1973 | Pitifer |
| RE28,625 | E | 11/1975 | Cunningham |
| 4,006,788 | A | 2/1977 | Garner |
| 4,108,259 | A | 8/1978 | Dixon et al. |
| 4,140,189 | A | 2/1979 | Garner |
| 4,187,922 | A | 2/1980 | Phelps |
| 4,190,126 | A | 2/1980 | Kabashima |
| 4,190,301 | A | 2/1980 | Becker et al. |
| 4,260,203 | A | 4/1981 | Garner |
| 4,270,812 | A | 6/1981 | Thomas |
| 4,285,409 | A | 8/1981 | Allen |
| 4,293,048 | A | 10/1981 | Kloesel, Jr. |
| 4,314,132 | A | 2/1982 | Porter |
| 4,320,808 | A | 3/1982 | Garrett |
| 4,343,371 | A | 8/1982 | Baker et al. |
| 4,359,112 | A | 11/1982 | Garner et al. |
| 4,359,114 | A | 11/1982 | Miller et al. |
| 4,369,849 | A | 1/1983 | Parrish |
| 4,386,669 | A | 6/1983 | Evans |
| 4,408,671 | A | 10/1983 | Munson |
| 4,410,284 | A | 10/1983 | Herrick |
| 4,428,687 | A | 1/1984 | Zahradnik |
| 4,444,281 | A | 4/1984 | Schumacher et al. |
| 4,448,269 | A | 5/1984 | Ishikawa et al. |
| 4,456,082 | A | 6/1984 | Harrison |
| 4,468,138 | A | 8/1984 | Nagel |
| 4,527,637 | A | 7/1985 | Bodine |
| 4,527,644 | A | 7/1985 | Allam |
| 4,572,306 | A | 2/1986 | Dorosz |
| 4,600,064 | A | 7/1986 | Scales et al. |
| 4,627,882 | A | 12/1986 | Soederstroem |
| 4,641,718 | A | 2/1987 | Bengtsson |
| 4,657,091 | A | 4/1987 | Higdon |
| 4,664,705 | A | 5/1987 | Horton et al. |
| 4,690,228 | A | 9/1987 | Voelz et al. |
| 4,706,765 | A | 11/1987 | Lee et al. |
| 4,726,718 | A | 2/1988 | Meskin et al. |
| 4,727,942 | A | 3/1988 | Galle et al. |
| 4,729,440 | A | 3/1988 | Hall |
| 4,738,322 | A | 4/1988 | Hall et al. |
| 4,756,631 | A | 7/1988 | Jones |
| 4,763,736 | A | 8/1988 | Varel, Sr. |
| 4,765,205 | A | 8/1988 | Higdon |
| 4,802,539 | A | 2/1989 | Hall et al. |
| 4,819,703 | A | 4/1989 | Rice et al. |
| 4,825,964 | A | 5/1989 | Rives |
| 4,865,137 | A | 9/1989 | Bailey et al. |
| 4,874,047 | A | 10/1989 | Hixon |
| 4,875,532 | A | 10/1989 | Langford, Jr. |
| 4,880,068 | A | 11/1989 | Bronson |
| 4,892,159 | A | 1/1990 | Holster |
| 4,892,420 | A | 1/1990 | Kruger |
| 4,915,181 | A | 4/1990 | Labrosse |
| 4,932,484 | A | 6/1990 | Warren et al. |
| 4,936,398 | A | 6/1990 | Auty et al. |
| 4,943,488 | A | 7/1990 | Sung et al. |
| 4,953,641 | A | 9/1990 | Pessier |
| 4,976,324 | A | 12/1990 | Tibbitts |
| 4,981,184 | A | 1/1991 | Knowlton et al. |
| 4,984,643 | A | 1/1991 | Isbell et al. |
| 4,991,671 | A | 2/1991 | Pearce et al. |
| 5,016,718 | A | 5/1991 | Tandberg |
| 5,027,912 | A | 7/1991 | Juergens |
| 5,027,914 | A | 7/1991 | Wilson |
| 5,028,177 | A | 7/1991 | Meskin et al. |
| 5,030,276 | A | 7/1991 | Sung et al. |
| 5,037,212 | A | 8/1991 | Justman et al. |
| 5,049,164 | A | 9/1991 | Horton et al. |
| 5,092,687 | A | 3/1992 | Hall |
| 5,116,568 | A | 5/1992 | Sung et al. |
| 5,137,097 | A | 8/1992 | Fernandez |
| 5,145,017 | A | 9/1992 | Holster et al. |
| 5,176,212 | A | 1/1993 | Tandberg |
| 5,199,516 | A | 4/1993 | Fernandez |
| 5,224,560 | A | 7/1993 | Fernandez |
| 5,238,074 | A | 8/1993 | Tibbitts et al. |
| 5,253,939 | A | 10/1993 | Hall |
| 5,287,936 | A | 2/1994 | Grimes et al. |
| 5,289,889 | A | 3/1994 | Gearhart et al. |
| 5,337,843 | A | 8/1994 | Torgrimsen et al. |
| 5,342,129 | A | 8/1994 | Dennis et al. |
| 5,346,026 | A | 9/1994 | Pessier et al. |
| 5,351,770 | A | 10/1994 | Cawthorne et al. |
| 5,361,859 | A | 11/1994 | Tibbitts |
| 5,429,200 | A | 7/1995 | Blackman et al. |
| 5,439,067 | A | 8/1995 | Huffstutler |
| 5,439,068 | A | 8/1995 | Huffstutler et al. |

(56) References Cited

U.S. PATENT DOCUMENTS 5,452,771 A 9/1995 Blackman et al.
5,467,836 A 11/1995 Grimes et al.
5,472,057 A 12/1995 Winfree
5,472,271 A 12/1995 Bowers et al.
5,494,123 A 2/1996 Nguyen
5,513,715 A 5/1996 Dysart
5,518,077 A 5/1996 Blackman et al.
5,531,281 A 7/1996 Murdock
5,547,033 A 8/1996 Campos, Jr.
5,553,681 A 9/1996 Huffstutler et al.
5,558,170 A 9/1996 Thigpen et al.
5,560,440 A 10/1996 Tibbitts
5,570,750 A 11/1996 Williams
5,593,231 A 1/1997 Ippolito
5,595,255 A 1/1997 Huffstutler
5,606,895 A 3/1997 Huffstutler
5,624,002 A 4/1997 Huffstutler
5,641,029 A 6/1997 Beaton et al.
5,644,956 A 7/1997 Blackman et al.
5,655,612 A 8/1997 Grimes et al.
D384,084 S 9/1997 Huffstutler et al.
5,695,018 A 12/1997 Pessier et al.
5,695,019 A * 12/1997 Shamburger, Jr. ..... E21B 10/04 175/333
5,755,297 A 5/1998 Young et al.
5,839,526 A 11/1998 Cisneros et al.
5,862,871 A 1/1999 Curlett
5,868,502 A 2/1999 Cariveau et al.
5,873,422 A 2/1999 Hansen et al.
5,941,322 A 8/1999 Deken et al.
5,944,125 A 8/1999 Byrd
5,967,246 A 10/1999 Caraway et al.
5,979,576 A 11/1999 Hansen et al.
5,988,303 A 11/1999 Arfele
5,992,542 A 11/1999 Rives
5,996,713 A 12/1999 Pessier et al.
6,045,029 A 4/2000 Scott
6,068,070 A 5/2000 Scott
6,092,613 A 7/2000 Caraway et al.
6,095,265 A 8/2000 Alsup
6,109,375 A 8/2000 Tso
6,116,357 A 9/2000 Wagoner et al.
6,170,582 B1 1/2001 Singh et al.
6,173,797 B1 1/2001 Dykstra et al.
6,190,050 B1 2/2001 Campbell
6,209,185 B1 4/2001 Scott
6,220,374 B1 4/2001 Crawford
6,241,034 B1 6/2001 Steinke et al.
6,241,036 B1 6/2001 Lovato et al.
6,250,407 B1 6/2001 Karlsson
6,260,635 B1 7/2001 Crawford
6,279,671 B1 8/2001 Panigrahi et al.
6,283,233 B1 9/2001 Lamine et al.
6,296,069 B1 10/2001 Lamine et al.
RE37,450 E 11/2001 Deken et al.
6,345,673 B1 2/2002 Siracki
6,360,831 B1 3/2002 Aakesson et al.
6,367,568 B2 4/2002 Steinke et al.
6,386,302 B1 5/2002 Beaton
6,401,844 B1 6/2002 Doster et al.
6,405,811 B1 6/2002 Borchardt
6,408,958 B1 6/2002 Isbell et al.
6,415,687 B2 7/2002 Saxman
6,427,791 B1 8/2002 Glowka et al.
6,427,798 B1 8/2002 Imashige
6,439,326 B1 8/2002 Huang et al.
6,446,739 B1 9/2002 Richman et al.
6,450,270 B1 9/2002 Saxton
6,460,635 B1 10/2002 Kalsi et al.
6,474,424 B1 11/2002 Saxman
6,510,906 B1 1/2003 Richert et al.
6,510,909 B2 1/2003 Portwood et al.
6,527,066 B1 3/2003 Rives
6,533,051 B1 3/2003 Singh et al.
6,544,308 B2 4/2003 Griffin et al.
6,561,291 B2 5/2003 Xiang
6,562,462 B2 5/2003 Griffin et al.
6,568,490 B1 5/2003 Tso et al.
6,581,700 B2 6/2003 Curlett et al.
6,585,064 B2 7/2003 Griffin et al.
6,589,640 B2 7/2003 Griffin et al.
6,592,985 B2 7/2003 Griffin et al.
6,601,661 B2 8/2003 Baker et al.
6,601,662 B2 8/2003 Matthias et al.
6,637,528 B2 10/2003 Nishiyama et al.
6,684,966 B2 2/2004 Lin et al.
6,684,967 B2 2/2004 Mensa-Wilmot et al.
6,729,418 B2 5/2004 Slaughter et al.
6,739,214 B2 5/2004 Griffin et al.
6,742,607 B2 6/2004 Beaton
6,745,858 B1 6/2004 Estes
6,749,033 B2 6/2004 Griffin et al.
6,797,326 B2 9/2004 Griffin et al.
6,823,951 B2 11/2004 Yong et al.
6,843,333 B2 1/2005 Richert et al.
6,861,098 B2 3/2005 Griffin et al.
6,861,137 B2 3/2005 Griffin et al.
6,878,447 B2 4/2005 Griffin et al.
6,883,623 B2 4/2005 McCormick et al.
6,902,014 B1 6/2005 Estes
6,922,925 B2 8/2005 Watanabe et al.
6,986,395 B2 1/2006 Chen
6,988,569 B2 1/2006 Lockstedt et al.
7,096,978 B2 8/2006 Dykstra et al.
7,111,694 B2 9/2006 Beaton
7,128,173 B2 10/2006 Lin et al.
7,137,460 B2 11/2006 Slaughter et al.
7,152,702 B1 12/2006 Bhome et al.
7,197,806 B2 4/2007 Boudreaux et al.
7,198,119 B1 4/2007 Hall et al.
7,234,549 B2 6/2007 McDonough et al.
7,234,550 B2 6/2007 Azar et al.
7,270,196 B2 9/2007 Hall
7,281,592 B2 10/2007 Runia et al.
7,292,967 B2 11/2007 McDonough et al.
7,311,159 B2 12/2007 Lin et al.
7,320,375 B2 1/2008 Singh
7,341,119 B2 3/2008 Singh et al.
7,350,568 B2 4/2008 Mandal et al.
7,350,601 B2 4/2008 Belnap et al.
7,360,612 B2 4/2008 Chen et al.
7,377,341 B2 5/2008 Middlemiss et al.
7,387,177 B2 6/2008 Zahradnik et al.
7,392,862 B2 7/2008 Zahradnik et al.
7,398,837 B2 7/2008 Hall et al.
7,416,036 B2 8/2008 Forstner et al.
7,435,478 B2 10/2008 Keshavan
7,458,430 B2 12/2008 Fyfe
7,462,003 B2 12/2008 Middlemiss
7,473,287 B2 1/2009 Belnap et al.
7,493,973 B2 2/2009 Keshavan et al.
7,517,589 B2 4/2009 Eyre
7,533,740 B2 5/2009 Zhang et al.
7,559,695 B2 7/2009 Sexton et al.
7,568,534 B2 8/2009 Griffin et al.
7,621,346 B1 11/2009 Trinh et al.
7,621,348 B2 11/2009 Hoffmaster et al.
7,647,991 B2 1/2010 Felderhoff et al.
7,703,556 B2 4/2010 Smith et al.
7,703,557 B2 4/2010 Durairajan et al.
7,819,208 B2 10/2010 Pessier et al.
7,836,975 B2 11/2010 Chen et al.
7,845,435 B2 12/2010 Zahradnik et al.
7,845,437 B2 12/2010 Bielawa et al.
7,847,437 B2 12/2010 Chakrabarti et al.
7,992,658 B2 8/2011 Buske
8,028,769 B2 10/2011 Pessier et al.
8,056,651 B2 11/2011 Turner et al.
8,177,000 B2 5/2012 Bhome et al.
8,201,646 B2 6/2012 Vezirian
8,302,709 B2 11/2012 Bhome et al.
8,356,398 B2 1/2013 McCormick et al.
8,950,514 B2 2/2015 Buske et al.
2001/0000885 A1 5/2001 Beuershausen et al.

(56) References Cited

U.S. PATENT DOCUMENTS

| | | | |
|---|---|---|---|
| 2001/0030066 | A1 | 10/2001 | Clydesdale et al. |
| 2002/0092684 | A1 | 7/2002 | Singh et al. |
| 2002/0100618 | A1 | 8/2002 | Watson et al. |
| 2002/0108785 | A1 | 8/2002 | Slaughter et al. |
| 2004/0031625 | A1 | 2/2004 | Lin et al. |
| 2004/0099448 | A1 | 5/2004 | Fielder et al. |
| 2004/0238224 | A1 | 12/2004 | Runia |
| 2005/0087370 | A1 | 4/2005 | Ledgerwood et al. |
| 2005/0103533 | A1 | 5/2005 | Sherwood et al. |
| 2005/0167161 | A1 | 8/2005 | Aaron et al. |
| 2005/0178587 | A1 | 8/2005 | Witman et al. |
| 2005/0183892 | A1* | 8/2005 | Oldham ..... E21B 10/42 175/402 |
| 2005/0252691 | A1 | 11/2005 | Bramlett et al. |
| 2005/0263328 | A1 | 12/2005 | Middlemiss |
| 2005/0273301 | A1 | 12/2005 | Huang |
| 2006/0027401 | A1 | 2/2006 | Nguyen |
| 2006/0032674 | A1 | 2/2006 | Chen et al. |
| 2006/0032677 | A1 | 2/2006 | Azar et al. |
| 2006/0162969 | A1 | 7/2006 | Belnap et al. |
| 2006/0196699 | A1 | 9/2006 | Estes et al. |
| 2006/0254830 | A1 | 11/2006 | Radtke |
| 2006/0266558 | A1 | 11/2006 | Middlemiss et al. |
| 2006/0266559 | A1 | 11/2006 | Keshavan et al. |
| 2006/0278442 | A1 | 12/2006 | Kristensen |
| 2006/0283640 | A1 | 12/2006 | Estes et al. |
| 2007/0029114 | A1 | 2/2007 | Middlemiss |
| 2007/0034414 | A1 | 2/2007 | Singh et al. |
| 2007/0046119 | A1 | 3/2007 | Cooley |
| 2007/0062736 | A1 | 3/2007 | Cariveau et al. |
| 2007/0079994 | A1 | 4/2007 | Middlemiss |
| 2007/0084640 | A1 | 4/2007 | Singh |
| 2007/0131457 | A1 | 6/2007 | McDonough et al. |
| 2007/0187155 | A1 | 8/2007 | Middlemiss |
| 2007/0221417 | A1 | 9/2007 | Hall et al. |
| 2007/0227781 | A1 | 10/2007 | Cepeda et al. |
| 2007/0272445 | A1 | 11/2007 | Cariveau et al. |
| 2008/0028891 | A1 | 2/2008 | Calnan et al. |
| 2008/0029308 | A1 | 2/2008 | Chen |
| 2008/0066970 | A1 | 3/2008 | Zahradnik et al. |
| 2008/0087471 | A1 | 4/2008 | Chen et al. |
| 2008/0093128 | A1 | 4/2008 | Zahradnik et al. |
| 2008/0156543 | A1 | 7/2008 | McDonough et al. |
| 2008/0164069 | A1 | 7/2008 | McDonough et al. |
| 2008/0264695 | A1 | 10/2008 | Zahradnik et al. |
| 2008/0296068 | A1 | 12/2008 | Zahradnik et al. |
| 2008/0308320 | A1 | 12/2008 | Kolachalam |
| 2009/0044984 | A1 | 2/2009 | Massey et al. |
| 2009/0114454 | A1 | 5/2009 | Belnap et al. |
| 2009/0120693 | A1 | 5/2009 | McClain et al. |
| 2009/0126998 | A1 | 5/2009 | Zahradnik et al. |
| 2009/0159338 | A1 | 6/2009 | Buske |
| 2009/0159341 | A1 | 6/2009 | Pessier et al. |
| 2009/0166093 | A1 | 7/2009 | Pessier et al. |
| 2009/0178855 | A1 | 7/2009 | Zhang et al. |
| 2009/0178856 | A1 | 7/2009 | Singh et al. |
| 2009/0183925 | A1 | 7/2009 | Zhang et al. |
| 2009/0236147 | A1 | 9/2009 | Koltermann et al. |
| 2009/0272582 | A1 | 11/2009 | McCormick et al. |
| 2009/0283332 | A1 | 11/2009 | Dick et al. |
| 2010/0012392 | A1 | 1/2010 | Zahradnik et al. |
| 2010/0018777 | A1 | 1/2010 | Pessier et al. |
| 2010/0043412 | A1 | 2/2010 | Dickinson et al. |
| 2010/0155146 | A1 | 6/2010 | Nguyen et al. |
| 2010/0224417 | A1 | 9/2010 | Zahradnik et al. |
| 2010/0252326 | A1 | 10/2010 | Bhome et al. |
| 2010/0276205 | A1 | 11/2010 | Oxford et al. |
| 2010/0288561 | A1 | 11/2010 | Zahradnik et al. |
| 2010/0319993 | A1 | 12/2010 | Bhome et al. |
| 2010/0320001 | A1 | 12/2010 | Kulkarni |
| 2011/0024197 | A1 | 2/2011 | Centala et al. |
| 2011/0079440 | A1 | 4/2011 | Buske et al. |
| 2011/0079441 | A1 | 4/2011 | Buske et al. |
| 2011/0079442 | A1 | 4/2011 | Buske et al. |
| 2011/0079443 | A1 | 4/2011 | Buske et al. |
| 2011/0085877 | A1 | 4/2011 | Osborne, Jr. |
| 2011/0162893 | A1 | 7/2011 | Zhang |
| 2012/0111638 | A1 | 5/2012 | Nguyen et al. |
| 2012/0205160 | A1 | 8/2012 | Ricks et al. |
| 2015/0152687 | A1 | 6/2015 | Nguyen et al. |
| 2015/0197992 | A1 | 7/2015 | Ricks et al. |

FOREIGN PATENT DOCUMENTS

| | | | |
|---|---|---|---|
| EP | 0157278 | A2 | 10/1985 |
| EP | 0225101 | A2 | 6/1987 |
| EP | 0391683 | A1 | 10/1990 |
| EP | 0874128 | A2 | 10/1998 |
| EP | 2089187 | A1 | 8/2009 |
| GB | 2183694 | A | 6/1987 |
| GB | 2194571 | A | 3/1988 |
| GB | 2364340 | A | 1/2002 |
| GB | 2403313 | A | 12/2004 |
| JP | 2000-080878 | A | 3/2000 |
| JP | 2001-159289 | A | 6/2001 |
| SU | 1331988 | A1 | 8/1987 |
| WO | 85/02223 | A1 | 5/1985 |
| WO | 2008/124572 | A1 | 10/2008 |
| WO | 2009/135119 | A2 | 11/2009 |
| WO | 2010/127382 | A1 | 11/2010 |
| WO | 2010/135605 | A2 | 11/2010 |
| WO | 2015/102891 | A1 | 7/2015 |

OTHER PUBLICATIONS

Written Opinion for International Patent Application No. PCT/US2015/032230, European Patent Office, dated Nov. 16, 2015.

Williams et al., "An Analysis of the Performance of PDG Hybrid Drill Bits", SPEIIADC 16117, SPE/IADC Drilling Conference, pp. 585-594, dated Mar. 1987.

Warren et al., "PDC Bits: What's Needed to Meet Tomorrow's Challenge", SPE 27978, University of Tulsa Cenlennial Petroleum Engineering Symposium, pp. 207-214, dated Aug. 1994.

Tomlinson et al.,"Rock Drilling- Syndax3 Pins—New Concepts in PCD Drilling", Industrial Diamond Review, pp. 109-114, dated Mar. 1992.

Thomas, S., International Search Report for International Patent Application No. PCT/US2015/014011, USPTO, dated Apr. 24, 2015.

Thomas, S, International Written Opinion for International Application No. PCT.US2015/014011 dated Apr. 24, 2015.

Sheppard et al., "Rock Drilling—Hybrid Bil Success for Syndax3 Pins", Industrial Diamond Review, pp. 309-311, dated Jun. 1993.

R. Buske, C. Rickabaugh, J. Bradford, H. Lukasewich and J. Overstreet. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Canada, Jun. 16-19, 2008.

Pessier, et al., "Hybrid Bits Offer Distinct Advantages in Selected Roller Cone and PDC Bil Applications", IADC/SPE Paper No. 128741, dated Feb. 2-4, 2010, pp. 1-9.

Ott, Written Opinion for International Patent Application No. PCT/US2010/049159, European Patent Office dated Apr. 21, 2011.

Office Action received for European Application No. 08850570.6, dated Nov. 25, 2011, 5 pages.

Office Action received for European Application No. 08850570.6, dated Apr. 12, 2011, 3 pages.

Mills Machine Company, "Rotary Hole Opener—Section 8", retrieved from the Internet on May 7, 2009 using <URL: http:1fwww.millsmachine.com/pages/home_page/mills_catalog/cat_holeopen/cal_holeopen_pdf>_.

Lee, Written Opinion for International Patent Application No. PCT/US2009/050672, Korean Intellectual Property Office dated Mar. 3, 2010.

Kim, Written Opinion for International Patent Application No. PCT/US2009/067969, Korean Intellectual Property Office, dated May 25, 2010.

(56) References Cited

OTHER PUBLICATIONS

Kang, Written Opinion for International Patent Application No. PCT/US2010/032511, Korean Intellectual Property Office, dated Jan. 17, 2011.
Kang, Written Opinion for International Patent Application No. PCT/US2010/033513, Korean Intellectual Property Office, dated Jan. 10, 2011.
Jung Flye Lee, Written Opinion for International Patent Application No. PCT/US2009/042514, Korean Intellectual Property Office, dated Nov. 27, 2009.
Jung Flye Lee, International Search Report for International Patent Application No. PCT/US2009/042514, Korean Intellectual Property Office, dated Nov. 27, 2009.
International Written Opinion for corresponding International patent application No. PCT/US2012/024134, dated Mar. 7, 2013.
International Search Report for International Patent Application No. PCT/US2010/049159, European Patent Office, dated Apr. 21, 2011.
International Search Report for International Patent Application No. PCT/US2009/050672, Korean Intellectual Property office, dated Mar. 3, 2010.
International Search Report for corresponding International patent application No. PCT/US2012/024134, dated Mar. 7, 2013.
International Search Report for International Patent Application No. PCT/US2010/033513, Korean Intellectual Property Office, dated Jan. 10, 2011.
International Search Report for International Patent Application No. PCT/US2010/032511, Korean Intellectual Property Office, dated Jan. 17, 2011.
International Search Report for International Patent Application No. PCT/US2009/067969, Korean Intellectual Property Office, dated May 25, 2010.
Georgescu, Written Opinion for International Patent Application No. PCT/US2011/042437, European Patent Office dated Nov. 9, 2011.
Georgescu, Written Opinion for International Patent Application No. PCT/US2010/051020, European Patent Office dated Jun. 1, 2011.
Georgescu, Written Opinion for International Patent Application No. PCT/US2010/051019, European Patent Office, dated Jun. 6, 2011.
Georgescu, Written Opinion for International Patent Application No. PCT/US2010/051017, European Patent Office, dated Jun. 8, 2011.
Georgescu, Written Opinion for International Patent Application No. PCT/US2010/051014, European Patent Office, dated Jun. 9, 2011.
Georgescu, Written Opinion for International Patent Application No. PCT/US2010/050631, European Patent Office dated Jun. 10, 2011.
Georgescu, International Search Report for International Patent Application No. PCT/US2011/042437, European Patent Office dated Nov. 9, 2011.
Georgescu, International Search Report for International Patent Application No. PCT/US2010/051020, European Patent Office, dated Jun. 1, 2011.
Georgescu, International Search Report for International Patent Application No. PCT/US2010/051019, European Patent Office, dated Jun. 6, 2011.
Georgescu, International Search Report for International Patent Application No. PCT/US2010/051017, European Patent Office, dated Jun. 8, 2011.
Georgescu, International Search Report for International Patent Application No. PCT/US2010/051014, European Patent Office dated Jun. 9, 2011.
Georgescu, International Search Report for International Patent Application No. PCT/US2010/050631, European Patent Office, dated Jun. 10, 2011.
Ersoy, A. and Waller, M. "Wear characteristics of PDC pin and hybrid core bits in rock drilling." Wear 188, Elsevier Science S.A., Mar. 1995, pp. 150-165.
Dr. M. Wells, T. Marvel and C. Beuershausen. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Indonesia, Aug. 25-27, 2008.
Dantinne, P, International Search Report for International Patent Application No. PCT/US2015/032230, European Patent Office, dated Nov. 16, 2015.
Choi, Written Opinion for International Patent Application No. PCT/US2010/039100, Korean Intellectual Property Office, dated Jan. 25, 2011.
Choi, International Search Report for International Patent Application No. PCT/US2010/0039100, Korean Intellectual Property Office, dated Jan. 25, 2011.
Canadian Office Action for CA Application No. 2,705,825 dated Jun. 11, 2012, 3 pages.
Canadian Office Action for CA Application No. 2,705,825 dated Feb. 12, 2013, 3 pages.
Canadian Office Action for CA Application No. 2,705,825 dated Dec. 6, 2013, 3 pages.
Canadian Office Action for CA Application No. 2,705,825 dated Aug. 31, 2011, 3 pages.
Beijer, International Preliminary Report on Palenlability for International Patent Application No. PCT/US2009/042514 the International Bureau of WIPO, dated Nov. 2, 2010.
Becamel, International Preliminary Report on Palenlability for the International Patent Application No. PCT/US2010/039100, The International Bureau ofWIPO, Switzerland, dated Jan. 5, 2012.
Baharlou, International Preliminary Report of Palenlability for International Patent Application No. PCT/US2009/050672, The International Bureau of WIPO, dated Jan. 25, 2011.

* cited by examiner

HYBRID DRILL BIT AND DESIGN METHOD

CROSS-REFERENCE TO RELATED APPLICATIONS

This application is a divisional of U.S. patent application Ser. No. 14/223,322, filed Mar. 24, 2014, now U.S. Pat. No. 10,316,589, issued Jun. 11, 2019, which is a continuation of U.S. patent application Ser. No. 12/271,033, filed Nov. 14, 2008, now U.S. Pat. No. 8,678,111, issued Mar. 25, 2014, which claims the benefit of U.S. Provisional Patent Application Ser. No. 60/988,718, filed Nov. 16, 2007, the disclosure of each of which is hereby incorporated herein in its entirety by this reference.

The subject matter of this application is related to the subject matter of U.S. patent application Ser. No. 12/061,536, filed Apr. 2, 2008, now U.S. Pat. No. 7,845,435, issued Dec. 7, 2010, which is a continuation-in-part of U.S. patent application Ser. No. 11/784,025, filed Apr. 5, 2007, now U.S. Pat. No. 7,841,426, issued Nov. 30, 2010, the disclosure of each of which is hereby incorporated herein in its entirety by this reference.

TECHNICAL FIELD

The present invention relates in general to earth-boring bits and, in particular, to an improved bit having a combination of rolling cutters and fixed cutters and cutting elements and a method of design and operation of such bits.

BACKGROUND

The success of rotary drilling enabled the discovery of deep oil and gas reservoirs and production of enormous quantities of oil. The rotary rock bit was an important invention that made the success of rotary drilling possible. Only soft earthen formations could be penetrated commercially with the earlier drag bit and cable tool, but the two-cone rock bit, invented by Howard R. Hughes, Sr., U.S. Pat. No. 930,759, drilled the caprock at the Spindletop field near Beaumont, Tex., with relative ease. That venerable invention, within the first decade of the last century, could drill a scant fraction of the depth and speed of the modern rotary rock bit. The original Hughes bit drilled for hours; the modern bit now drills for days. Modern bits sometimes drill for thousands of feet instead of merely a few feet. Many advances have contributed to the impressive improvements in rotary rock bits.

In drilling boreholes in earthen formations using rolling-cone or rolling-cutter bits, rock bits having one, two, or three rolling cutters rotatably mounted thereon are employed. The bit is secured to the lower end of a drill string that is rotated from the surface or by downhole motors or turbines. The cutters mounted on the bit roll and slide upon the bottom of the borehole as the drill string is rotated, thereby engaging and disintegrating the formation material to be removed. The rolling cutters are provided with cutting elements or teeth that are forced to penetrate and gouge the bottom of the borehole by weight from the drill string. The cuttings from the bottom and sides of the borehole are washed away and disposed by drilling fluid that is pumped down from the surface through the hollow, rotating drill string, and the nozzles as orifices on the drill bit. Eventually the cuttings are carried in suspension in the drilling fluid to the surface up the exterior of the drill string.

Rolling-cutter bits dominated petroleum drilling for the greater part of the $20^{th}$ century. With improvements in synthetic diamond technology that occurred in the 1970s and 1980s, the fixed-blade cutter bit or "drag" bit became popular again in the latter part of the $20^{th}$ century. Modern fixed-blade cutter bits are often referred to as "diamond" or "PDC" (polycrystalline diamond) cutter bits and are far removed from the original fixed-blade cutter bits of the $19^{th}$ and early $20^{th}$ centuries. Diamond or PDC bits carry cutting elements comprising polycrystalline diamond compact layers or "tables" formed on and bonded to a supporting substrate, conventionally of cemented tungsten carbide, the cutting elements being arranged in selected locations on blades or other structures on the bit body with the diamond tables facing generally in the direction of bit rotation. Fixed-blade cutter bits have the advantage of being much more aggressive during drilling and therefore drill much faster at equivalent weight-on-bit levels (WOB) than, for instance, a rolling-cutter bit. In addition, they have no moving parts, which make their design less complex and more robust. The drilling mechanics and dynamics of fixed-blade cutter bits are different from those of rolling-cutter bits precisely because they are more aggressive in cutting and require more torque to rotate during drilling. During a drilling operation, fixed-blade cutter bits are used in a manner similar to that for rolling-cutter bits, the fixed-blade cutter bits also being rotated against a formation being drilled under applied weight-on-bit to remove formation material. The cutting elements on the fixed-blade cutters are continuously engaged as they scrape material from the formation, while in a rolling-cutter bit the cutting elements on each rolling cutter indent the formation intermittently with little or no relative motion (scraping) between the cutting element and the formation. A rolling-cutter bit and a fixed-blade cutter bit each have particular applications for which they are more suitable than the other. The much more aggressive fixed-blade cutter bit is superior in drilling in a softer formation to a medium hard formation while the rolling-cutter bit excels in drilling hard formations, abrasive formations, or any combination thereof.

In the prior art, some earth-boring bits use a combination of one or more rolling cutters and one or more fixed-blade cutters. Some of these combination-type drill bits are referred to as hybrid bits. Previous designs of hybrid bits, such as U.S. Pat. No. 4,343,371, to Baker, III, have used rolling cutters to do most of the formation cutting, especially in the center of the hole or bit. Another type of hybrid bit described in U.S. Pat. No. 4,444,281, to Schumacher, has equal numbers of fixed-blade cutters and rolling cutters in essentially symmetrical arrangements. In such bits, the rolling cutters do most of the cutting of the formation while the fixed-blade cutters act as scrapers to remove uncut formation indentations left by the rolling cutters, as well as cuttings left behind by the rolling cutters. While such a hybrid bit improves the cutting efficiency of the hybrid bit over that of a rolling-cutter bit in softer formations, it has only a small or marginal effect on improving the overall performance in harder formations. When comparing a fixed-blade cutter bit to a rolling-cutter bit, the high cutting aggressiveness of a fixed-blade cutter bit frequently causes such bit to reach the torque capacity or limit of a conventional rotary table drilling systems or motors, even at a moderate level of weight-on-bit during drilling, particularly on larger diameter drill bits. The reduced cutting aggressiveness of a rolling-cutter bit, on the other hand, frequently causes the rolling-cutter bit to exceed the weight-on-bit limits of the drill string before reaching the full torque capacity of a conventional rotary table drive drilling system.

None of the prior art addresses the large difference in cutting aggressiveness between rolling-cutter bits and fixed-blade cutter bits. Accordingly, an improved hybrid bit with adjustable cutting aggressiveness that falls between or midway between the cutting aggressiveness of a rolling-cutter bit and a fixed-blade cutter bit would be desirable.

BRIEF SUMMARY

A hybrid earth-boring bit comprising a bit body having a central axis, at least one, preferably three fixed-blade cutters, depending downwardly from the bit body, each fixed-blade cutter having a leading edge, and at least one rolling cutter, preferably three rolling cutters, mounted for rotation on the bit body is disclosed. A fixed-blade cutter and a rolling cutter form a pair of cutters on the hybrid bit body. When there are three rolling cutters, each rolling cutter is located between two fixed-blade cutters.

A plurality of cutting elements is arranged on the leading edge of each fixed-blade cutter and a plurality of cutting elements is arranged on each of the rolling cutters. The rolling cutters each have cutting elements arranged to engage formation in the same swath or kerf or groove as a matching cutting element on a fixed-blade cutter. In the pair of cutters, the matching fixed-blade cutter being arranged to be either trailing, leading, or opposite the rolling cutter to adapt the hybrid bit to the application by modifying the cutting aggressiveness thereof to get the best balance between the rate-of-penetration of the bit and the durability of the bit for the pair of cutters.

A method for designing a hybrid earth-boring bit of the present invention permits or allows the cutting aggressiveness of a hybrid bit to be adjusted or selected based on the relationship of at least a pair of cutters comprising a fixed-blade cutter and a rolling cutter, of a plurality of fixed-blade cutters and rolling cutters, wherein the relationship includes a fixed-blade cutter leading a rolling cutter in a pair of cutters, a rolling cutter leading a fixed-blade cutter in a pair of cutters, a rolling cutter being located opposite a fixed-blade cutter in a pair of cutters on the bit, and the angular relationship of a fixed-blade cutter and a rolling cutter of a pair of cutters regarding the amount of leading or trailing of the cutter from an associated cutter of the pair of cutters. The cutting aggressiveness of a hybrid bit of the present invention being achieved by defining a cutting aggressiveness of a hybrid drill bit and the various combinations of pairs of a fixed-blade cutters and rolling cutters, when compared to each other and to different types of drill bits, such as a rolling-cutter drill bit and a fixed-blade cutter drill bit, either as the ratio of torque to weight-on-bit or as the ratio of rate-of-penetration to weight-on-bit. The cutting aggressiveness for a hybrid bit of the present invention being adjusted by performing at least one of the following steps:

- adjusting the angular distance between each rolling cutter and each fixed-blade cutter of a pair of cutters of the bit;
- adjusting the effective projection of the cutting elements on a rolling cutter;
- arranging the cutting elements of a fixed-blade cutter and the cutting elements of a rolling cutter so that at least one cutting element of a rolling cutter and at least one cutting element of a fixed-blade cutter cut the same swath or kerf or groove during a drilling operation; and
- arranging a pair of at least one fixed-blade cutter and a rolling cutter so that the rolling cutter either leads the fixed-blade cutter [(<180°) angular distance], the rolling cutter opposes the fixed-blade cutter [(=180°) angular distance], or trails the fixed-blade cutter [(>180°) angular distance].

Other features and advantages of the present invention become apparent with reference to the drawings and detailed description of the invention.

DETAILED DESCRIPTION

Figure 1:
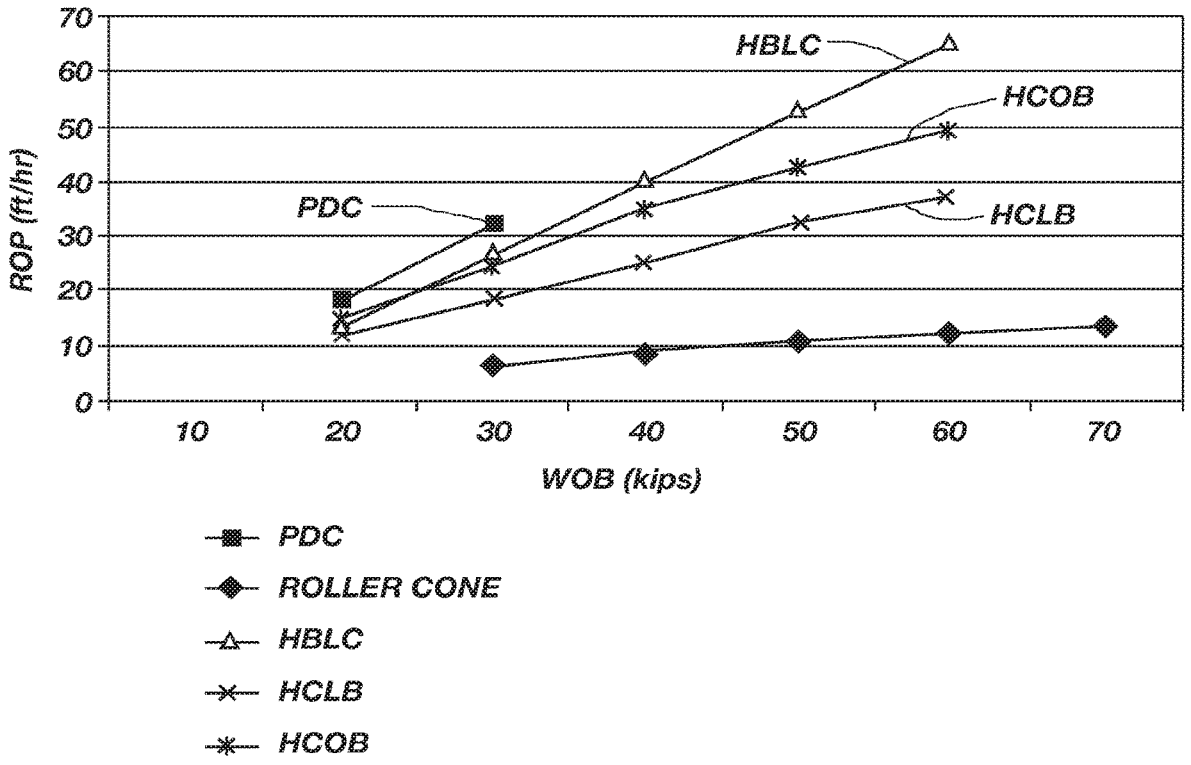
FIG. 1 is a graph illustrating the relative aggressiveness of a rolling-cutter bit, a fixed-blade cutter bit having polycrystalline diamond cutters or PDC bit, and embodiments of hybrid bits of the present disclosure.

Turning now to the drawing figures, and particularly to FIG. 1, the characteristics of various embodiments of the present invention are described. FIG. 1 is a graph of rate-of-penetration (ROP on y-axis) versus weight-on-bit (WOB on x-axis) for earth-boring bits such as a fixed-blade cutter bit, a hybrid bit of the present invention, and a three rolling-cutter bit (three roller-cone bit). The data for the bits illustrated in the graph was generated using 12¼-inch bits on the simulator of Baker Hughes, a GE Company, formerly known as Hughes Christensen in The Woodlands, Tex. The conditions were 4000 pounds per square inch of bottom-hole pressure, 120 bit revolutions per minute, and 9.5 pounds per gallon drilling fluid or mud while drilling Carthage marble. The data used and reflected in FIG. 1 is intended to be general and to reflect general characteristics for the three types of bits, such as fixed-blade cutter bits having PDC cutting elements, hybrid bits including variations thereof of the present disclosure, and rolling-cutter bits (roller-cone bits) whose cutting aggressiveness characteristics are illustrated.

The graph shows the performance characteristics of three different types of earth-boring bits: a three rolling-cutter bit (three roller cones), a six blade fixed cutter bit having PDC cutting elements, and a "hybrid" bit having both (three) rolling cutters and (three) fixed-blade cutters. As shown, each type of bit has a characteristic line. The six fixed-blade cutter bit having PDC cutting elements has the highest ROP for a given WOB resulting in a line having the steepest slope of the line showing cutting performance of the bit. However, the PDC bit could not be run at high weight-on-bit because of high vibrations of the bit. The three rolling-cutter bit (three roller-cone bit) has the lowest ROP for a given WOB resulting in a line having the shallowest slope of the line showing cutting performance of the bit. The hybrid bit in the three embodiments of the present invention exhibits intermediate ROP for a given WOB resulting in lines having an intermediate slopes of the lines showing cutting performance of the bit between the lines for the fixed-blade cutter bit and the three rolling-cutter bit.

The slope of the line (curve) plotted for ROP versus WOB for a given bit can be termed or defined as the bit's cutting aggressiveness or simply "Aggressiveness" as used herein. "Aggressiveness," for purposes of this application and the disclosure described herein, is defined as follows:

$$\text{(1) Aggressiveness} = \text{Rate-of-Penetration (ROP)} / \text{Weight-on-Bit (WOB)} \quad (1)$$

Thus aggressiveness, as the mathematical slope of a line, has a value greater than zero. Measured purely in terms of aggressiveness, it would seem that fixed-blade cutter bits would be selected in all instances for drilling. However, other factors come into play. For example, there are limits on the amount of WOB and torque to turn the bit that can be applied, generally based on either the drilling application or the capacity of the drill string and drilling rig. For example, as WOB on a fixed-blade cutter bit increases the drill string torque requirement increases rapidly, especially with fixed-blade cutter bits, and erratic torque can cause harmful vibrations. Rolling-cutter bits, on the other hand, require high WOB which, in the extreme, may buckle a bottom hole assembly or exceed the load bearing capacity of the cutter bearings of the rolling cutters of the rolling-cutter bit. Accordingly, different types of bits, whether a fixed-blade cutter bit, a rolling-cutter bit, or a hybrid bit, have different advantages in different situations. One aspect of the present invention is to provide a method for the design of a hybrid earth-boring bit so that its aggressiveness characteristics can be tailored or varied to the drilling application.

Figure 2:
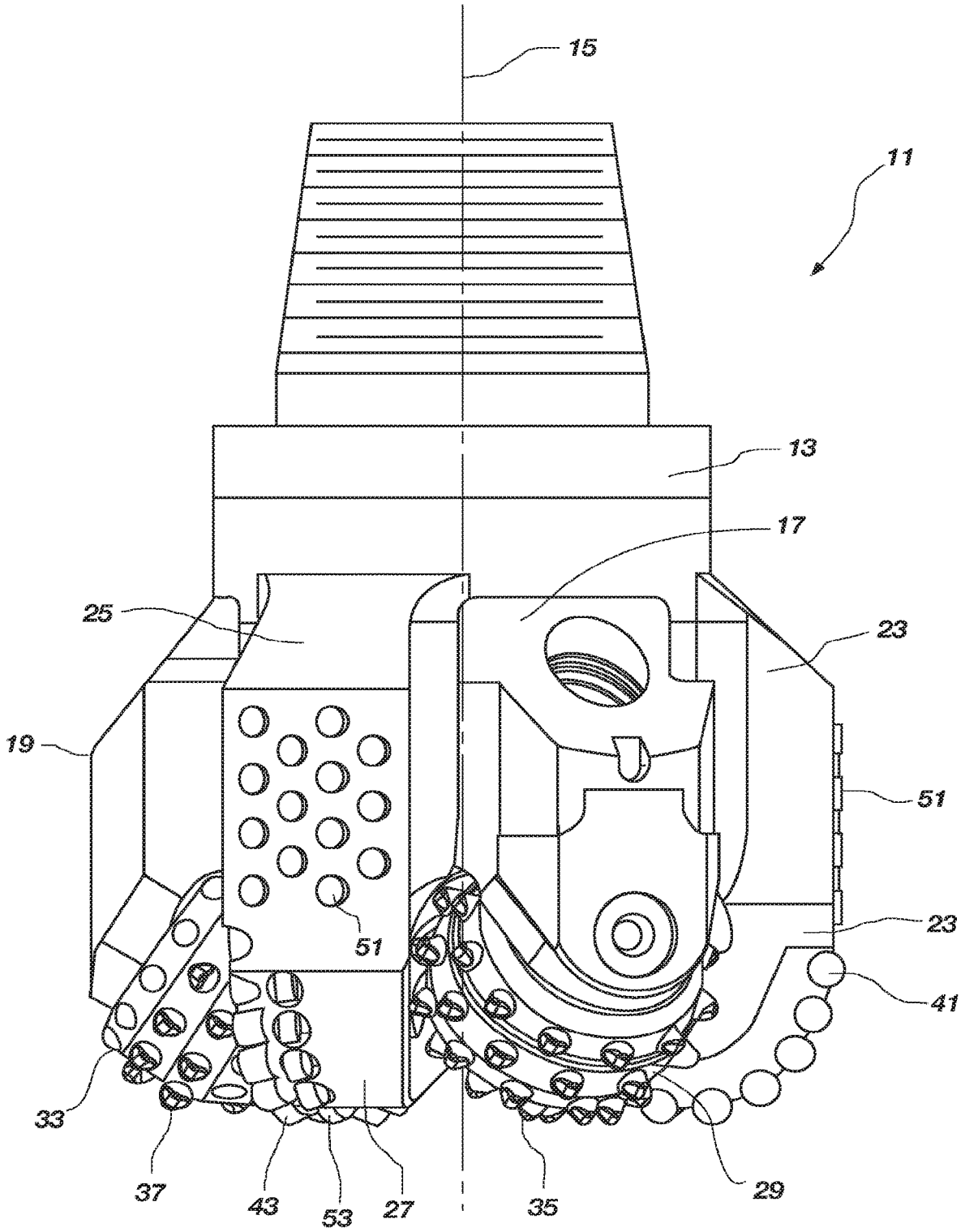
FIG. 2 is an elevation view of a hybrid earth-boring bit illustrative of the present invention.
Figure 3:
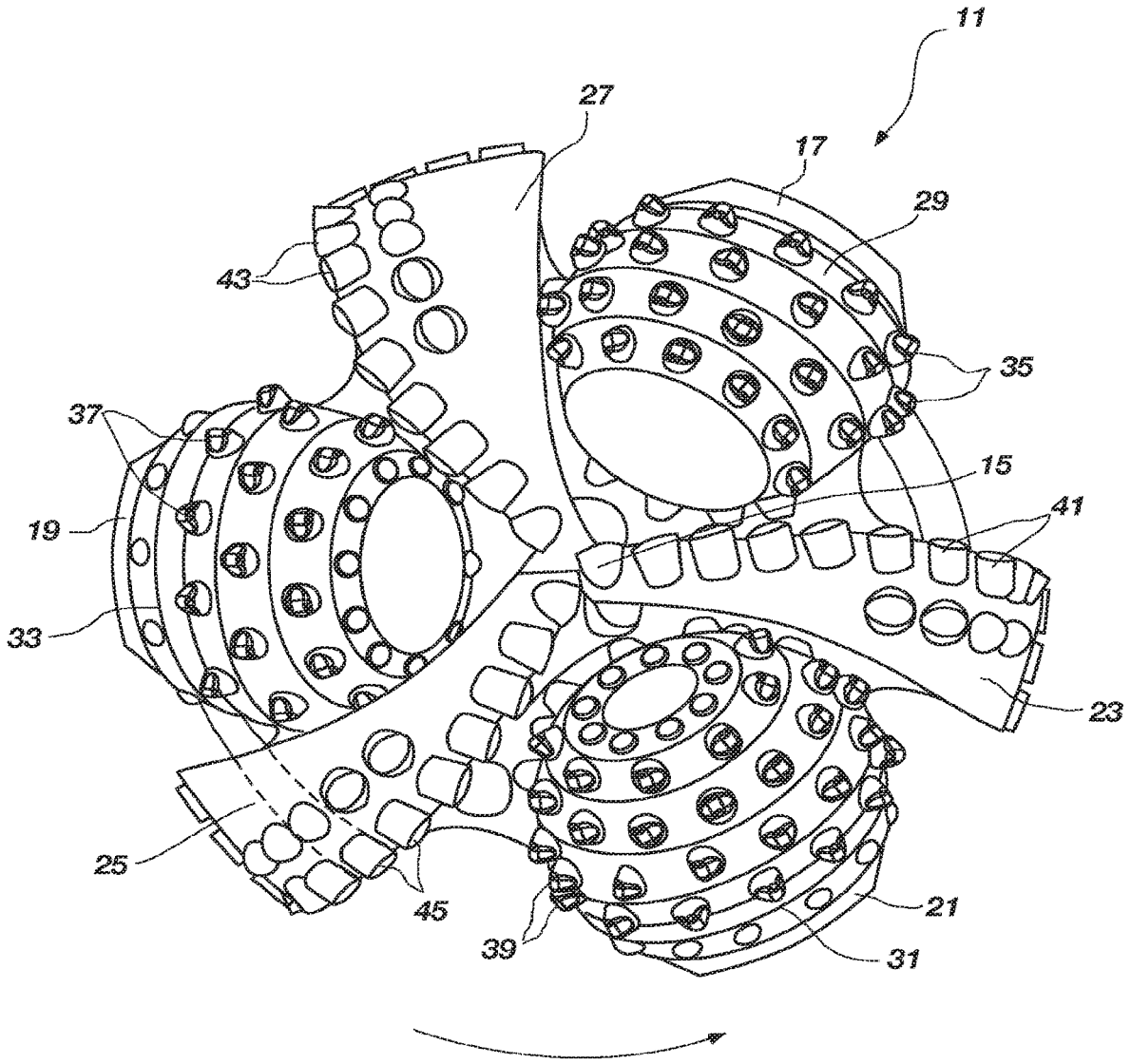
FIG. 3 is a bottom plan form view of the hybrid earth-boring bit of FIG. 2.
Figure 4:
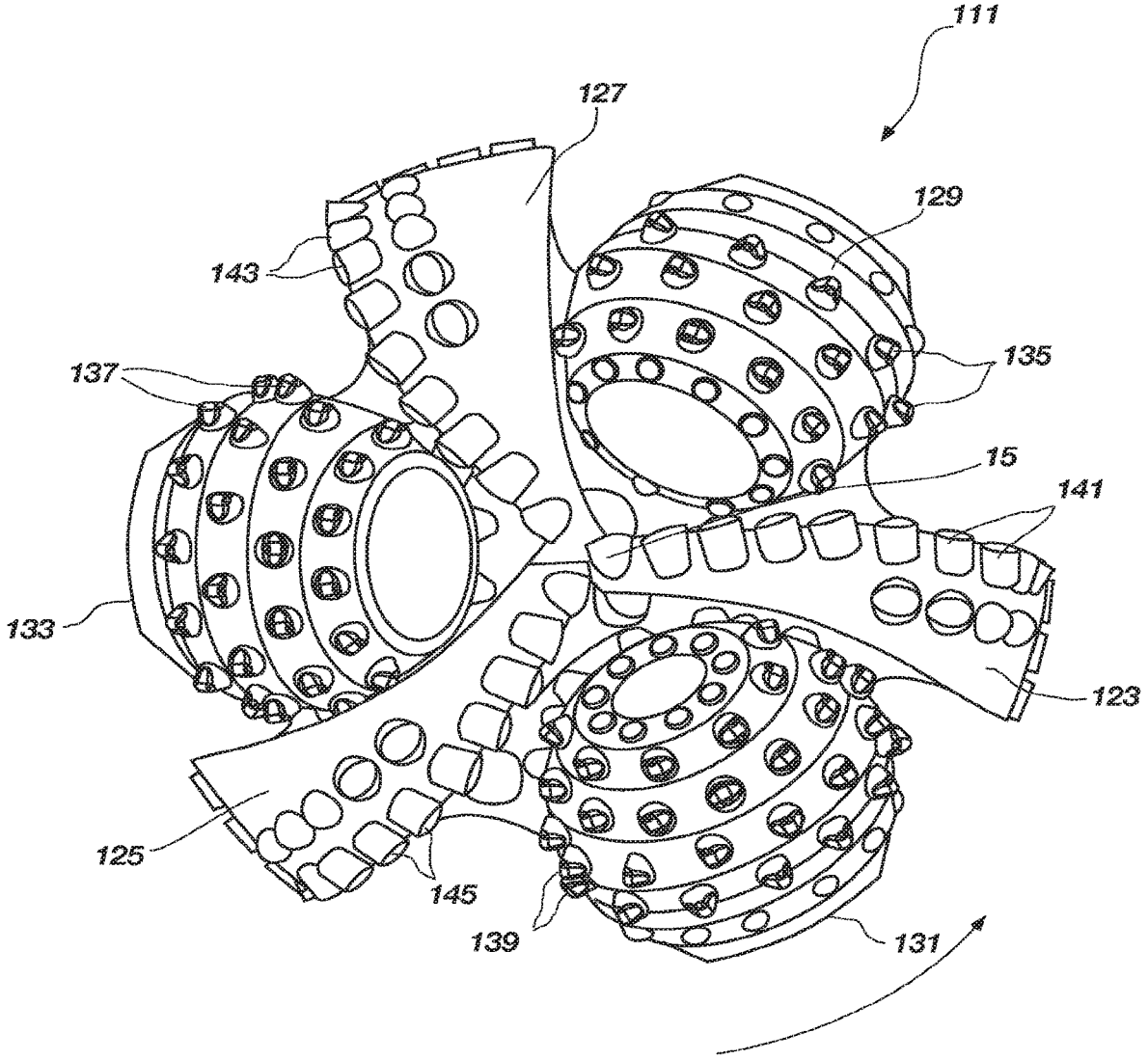
FIG. 4 is a bottom plan form view of another embodiment of a hybrid earth-boring bit of the present invention.

FIGS. 2, 3, and 4 illustrate embodiments of hybrid earth-boring bits 11 according to the present invention. Hybrid bit 11 comprises a bit body 13 that is threaded or otherwise configured at its upper extent for connection into a drill string. Bit body 13 may be constructed of steel, or of a hard-metal (e.g., tungsten carbide) matrix material with steel inserts. Bit body 13 has an axial center or centerline 15 that coincides with the axis of rotation of hybrid bit 11 in most instances. The illustrated hybrid bit 11 is a 12¼-inch bit. The hybrid bit 11 shown in FIG. 3 is used to exemplify the techniques of adjusting the aggressiveness of a hybrid bit according to the present invention, i.e., "cutter-leading," "blade-leading," and "cutter-blade opposite," as described herein. One of the embodiments of the hybrid bits of the present disclosure illustrated in FIG. 3, is likely not a desirable production hybrid bit design when the hybrid bit is an all blade-leading design because aggressiveness of the hybrid bit is too great for certain types of formations, but not all types of formations. That is, if the hybrid bit is a hybrid bit having an all blade-leading design, it acts more as a fixed-blade cutter bit. As illustrated in FIG. 1, aggressiveness of such hybrid bit is high which might adversely affect its durability and dynamic stability.

Illustrated in FIG. 2 and FIG. 3, at least one bit leg (two of three are shown in FIG. 2) 17, 19, 21 depends axially downwardly from the bit body 13. In the illustrated embodiment, a lubricant compensator is associated with each bit leg to compensate for pressure variations in the lubricant provided for the bearing. In between each bit leg 17, 19, 21, at least one fixed-blade cutter 23, 25, 27 depends axially downwardly from bit body 13.

A rolling cutter 29, 31, 33 is mounted for rotation (typically on a journal bearing, but rolling element or other bearings may be used as well) on each bit leg 17, 19, 21. Each rolling cutter 29, 31, 33 has a plurality of cutting elements 35, 37, 39 arranged in generally circumferential rows thereon. In the illustrated embodiment, cutting elements 35, 37, 39 are tungsten carbide inserts, each insert having an interference fit into bores or apertures formed in each rolling cutter 29, 31, 33. Alternatively, cutting elements 35, 37, 39 can be integrally formed with the cutter and hardfaced, as in the case of steel- or milled-tooth cutters. Materials other than tungsten carbide, such as polycrystalline diamond or other superhard or superabrasive materials, can also be used for rolling-cutter cutting elements 35, 37, 39 on rolling cutters 29, 31, 33.

A plurality of cutting elements 41, 43, 45 is arranged in a row on the leading edge of each fixed-blade cutter 23, 25, 27. Each cutting element 41, 43, 45 is a circular disc of polycrystalline diamond mounted to a stud of tungsten carbide or other hard metal, which is, in turn, soldered, brazed or otherwise secured to the leading edge of each fixed-blade cutter. Thermally stable polycrystalline diamond (TSP) or other conventional fixed-blade cutting element materials may also be used. Each row of cutting elements 41, 43, 45 on each of the fixed-blade cutters 23, 25, 27 extends from the central portion of bit body 13 to the radially outermost or gage portion or surface of bit body 13. On at least one of the rows on one of the fixed-blade cutters 23, 25, 27, a cutting element 41 on a first fixed-blade cutter 23 is located at or near the central axis or centerline 15 of bit body 13 ("at or near" meaning some part of the fixed cutter is at or within about 0.040 inch of the axial centerline 15). In the illustrated embodiment, the radially innermost cutting element 41 in the row on fixed-blade cutter 23 has its circumference tangent to the axial center or centerline 15 of the bit body 13 and hybrid bit 11.

A plurality of flat-topped, wear-resistant inserts 51 formed of tungsten carbide or similar hard metal with a polycrystalline diamond cutter attached thereto are provided on the radially outer most or gage surface of each fixed-blade cutter 23, 25, 27. These serve to protect this portion of the bit from abrasive wear encountered at the sidewall of the borehole. Also, a row or any desired number of rows of backup cutters 53 is provided on each fixed-blade cutter 23, 25, 27 between the leading and trailing edges thereof. Backup cutters 53 may be aligned with the main or primary cutting elements 41, 43, 45 on their respective fixed-blade cutters 23, 25, 27 so that they cut in the same swath or kerf or groove as the main or primary cutting elements on a fixed-blade cutter. Alternatively, they may be radially spaced apart from the main fixed-blade cutting elements so that they cut in the same swath or kerf or groove or between the same swaths or kerfs or grooves formed by the main or primary cutting elements on their respective fixed-blade cutters. Additionally, backup cutters 53 provide additional points of contact or engagement between the hybrid bit 11 and the formation being drilled, thus enhancing the stability of hybrid bit 11.

In the embodiments of the disclosure illustrated in FIG. 3, rolling cutters 29, 31, 33 are angularly spaced approximately 120 degrees apart from each other (measured between their axes of rotation). The axis of rotation of each rolling cutter 29, 31, 33 intersects the axial center 15 of bit body 13 (FIG. 2) or hybrid bit 11, although each or all of the rolling cutters 29, 31, 33 may be angularly skewed by any desired amount and (or) laterally offset so that their individual axes do not intersect the axial center of bit body 13 (FIG. 2) or hybrid bit 11. As illustrated, a first rolling cutter 29 is spaced apart 58 degrees from a first fixed-blade cutter 23 (measured between the axis of rotation of rolling cutter 29 and the centerline of first fixed-blade cutter 23 in a clockwise manner in FIG. 3) forming a pair of cutters. A second rolling cutter 31 is spaced 63 degrees from a second fixed-blade cutter 25 (measured similarly) forming a pair of cutters; and a third rolling cutter 33 is spaced 53 degrees apart from a third fixed-blade cutter 27 (again measured the same way) forming a pair of cutters.

Figure 3A:
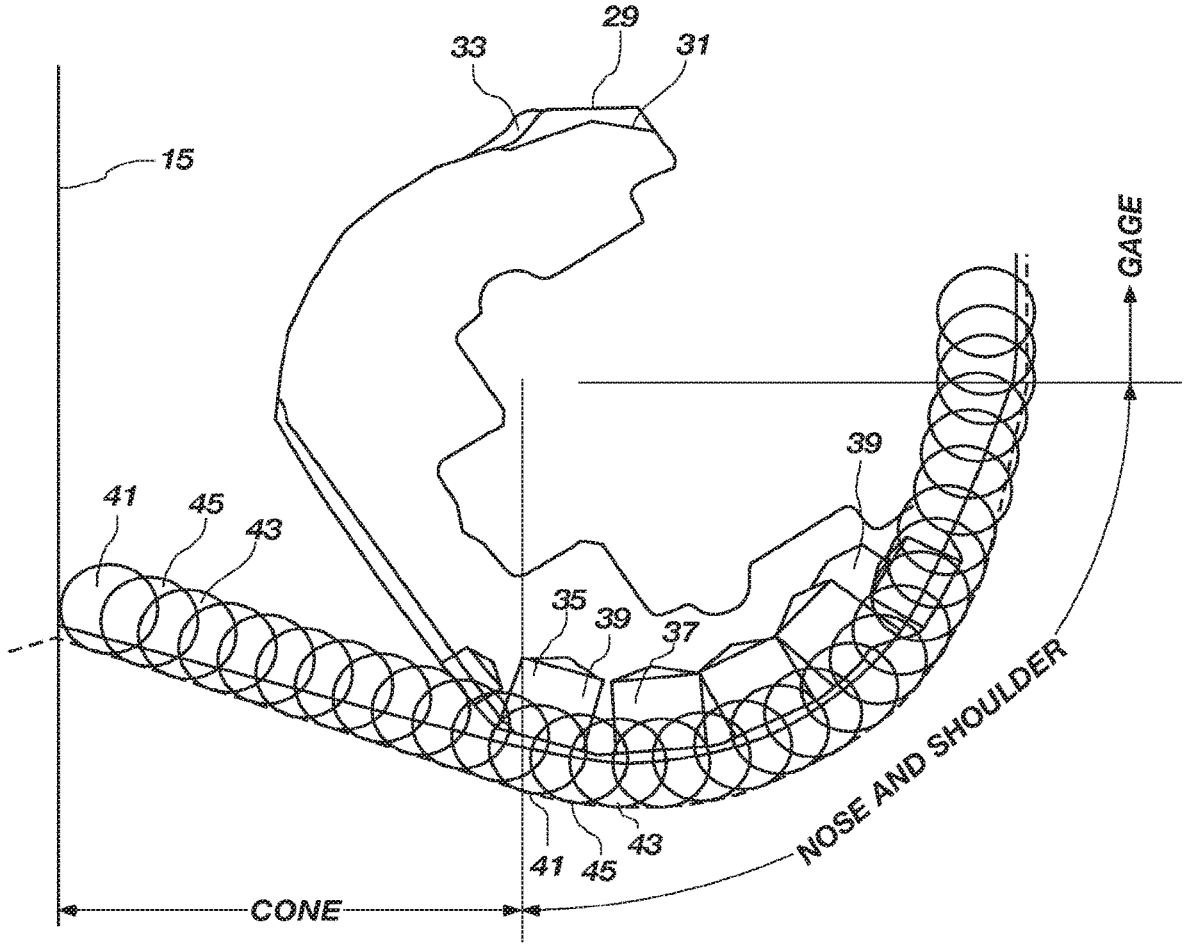
FIG. 3A is a profile view of cutting elements of three fixed-blade cutters and cutting elements of three rolling cutters of an embodiment of a hybrid bit of the present disclosure of FIGS. 1 through 3.

In FIG. 3A, a cutting profile for the fixed cutting elements 41, 45, 43 on fixed-blade cutters 23, 25, 27 (not shown) and cutting elements 35, 37, 39 on rolling cutters 29, 33, 31 are generally illustrated. As illustrated, an innermost cutting element 41 on first fixed-blade cutter 23 is tangent to the axial centerline 15 of the bit body 13 or hybrid bit 11. The innermost cutting element 43 on third fixed-blade cutter 27 is illustrated. Also, innermost cutting element 45 on second fixed-blade cutter 25 is also illustrated. A cutting element 35 on rolling cutter 29 is illustrated having the same cutting depth or exposure and cutting element 41 on first fixed-blade cutter 23 each being located at the same centerline and cutting the same swath or kerf or groove. Some cutting elements 41 on first fixed-blade cutter 23 are located in the cone of the hybrid bit 11, while other cutting elements 41 are located in the nose and shoulder portion of the hybrid bit 11 having cutting elements 35 of rolling cutter 29 cutting the same swath or kerf or groove generally in the nose and shoulder of the hybrid bit 11 out to the gage thereof. Cutting elements 35, 37, 39 on rolling cutters 29, 33, 31 do not extend into the cone of the hybrid bit 11 but are generally located in the nose and shoulder of the hybrid bit 11 out to the gage of the hybrid bit. Further illustrated in FIG. 3A are the cutting elements 37, 39 on rolling cutters 31 and 33 and their relation to the cutting elements 43 and 45 on fixed-blade cutters 27, 25 cutting the same swath or kerf or groove either being centered thereon or offset in the same swath or kerf or groove during a revolution of the hybrid drill bit 11. While each cutting element 41, 45, 43 and cutting element 35, 37, 39 has been illustrated having the same exposure of depth of cut so that each cutting element cuts the same amount of formation, the depth of cut may be varied in the same swath or kerf or groove, if desired.

Figure 3B:
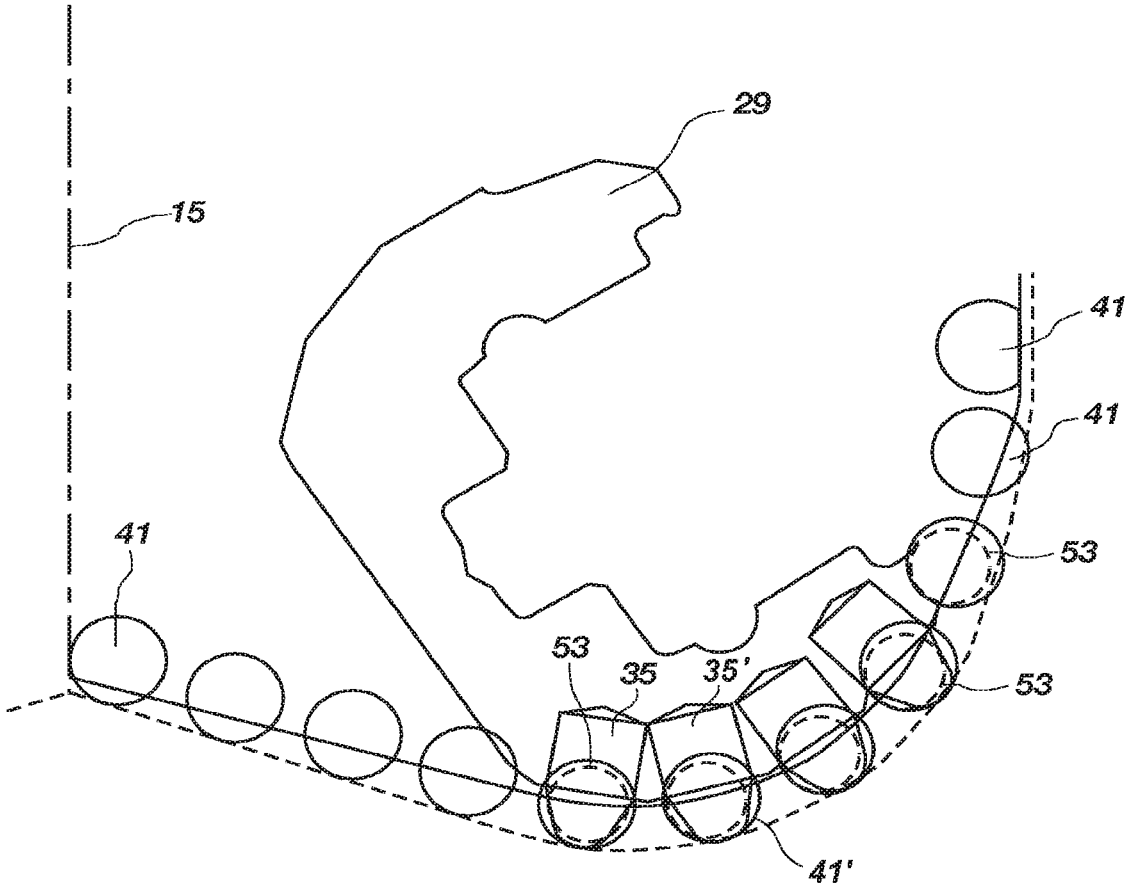
FIG. 3B is a profile view of cutting elements of a first fixed-blade cutter and cutting elements of a first rolling cutter of an embodiment of a hybrid bit of the present invention.

Illustrated in FIG. 3B is a cutting profile for the fixed cutting elements 41 on first fixed-blade cutter 23 and cutting elements 35 on rolling cutter 29 in relation to the each other, the first fixed-blade cutter 23 and the rolling cutter 29 forming a pair of cutters on hybrid bit 11. As illustrated, some of the cutting elements 41 on first fixed-blade cutter 23 and cutting elements 35 on rolling cutter 29 both have the same center and cut in the same swath or kerf or groove while other cutting elements 41' on fixed-blade cutter 23 and cutting elements 35' on rolling cutter 29 do not have the same center but still cut in the same swath or kerf or groove. As illustrated, all the cutting elements 41 and 41' on fixed-blade cutter 23 and cutting elements 35 and 35' on rolling cutter 29 have the same exposure to cut the same depth of formation for an equal cut of the formation during a revolution of the hybrid drill bit 11, although this may be varied as desired. Further illustrated in FIG. 3B in broken lines, backup cutters 53 on first fixed-blade cutter 23 located behind cutting elements 41 may have the same exposure of cut as cutting elements 41 or less exposure of cut as cutting elements 41 and have the same diameter or a smaller diameter than a cutting element 41. Additionally, backup cutters 53 while cutting in the same swath or kerf or groove as a cutting element 41 may be located off the center of a cutting element 41 located in front of a backup cutter 53 associated therewith. In this manner, cutting elements 41 and backup cutters 53 on first fixed-blade cutter 23 and cutting elements 35 on rolling cutter 29 will all cut in the same swath or kerf or groove while being either centered on each other or slightly off-centered from each other having the same exposure of cut or, in the alternative, a lesser exposure of cut.

Figure 3C:
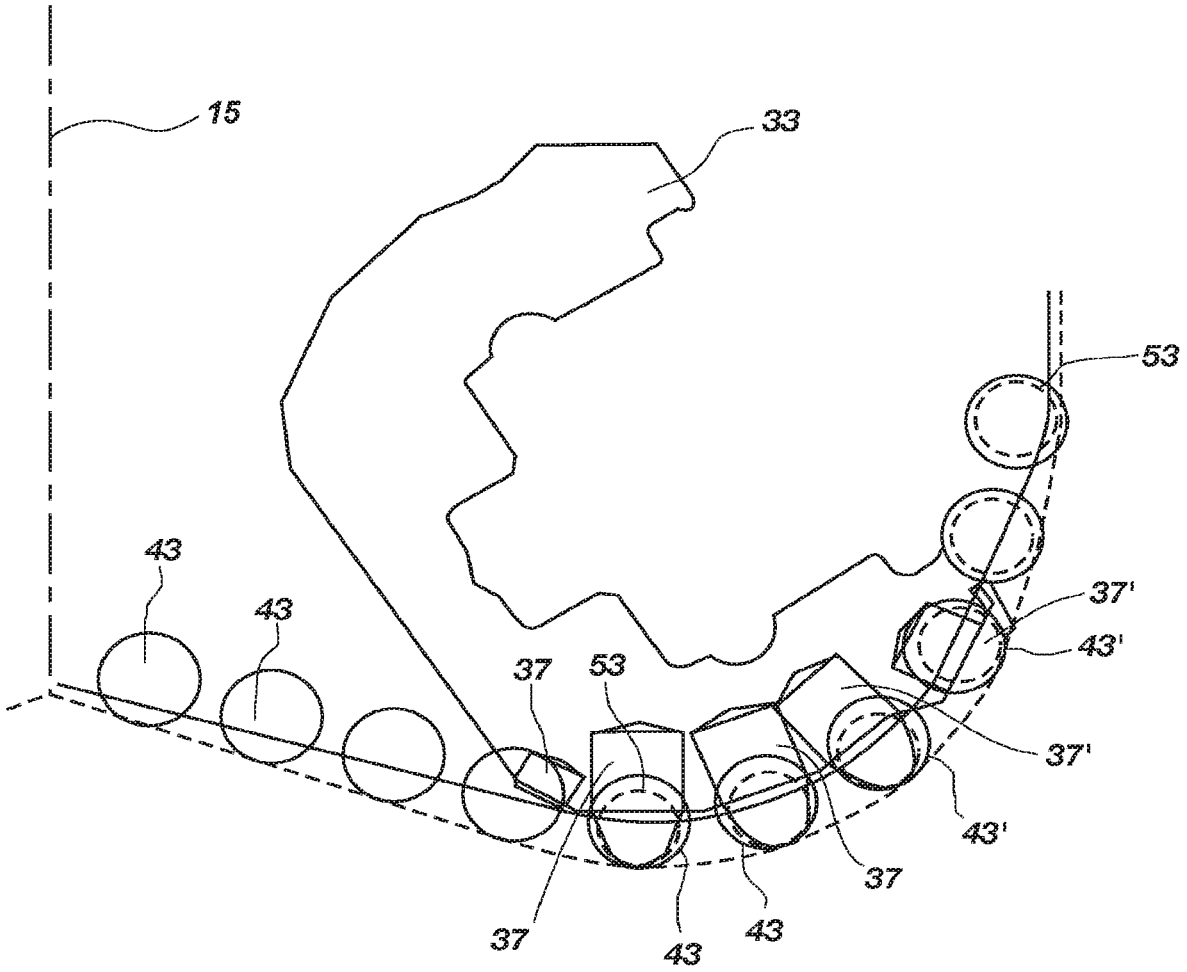
FIG. 3C is a profile view of cutting elements of a second fixed-blade cutter and cutting elements of a second rolling cutter of an embodiment of a hybrid bit of the present invention.

Illustrated in FIG. 3C is a cutting profile for the fixed cutting elements 43 on third fixed-blade cutter 27 in relation to the cutting elements 37 on third rolling cutter 33, the third fixed-blade cutter 27 and the third rolling cutter 33 forming a pair of cutters on hybrid bit 11. As illustrated, some of the cutting elements 43 on fixed-blade cutter 27 and cutting elements 37 on third rolling cutter 33 both have the same center and cutting in the same swath or kerf or groove while other cutting elements 43' on fixed-blade cutter 23 and cutting elements 37' on rolling cutter 33 do not have the same center but cut in the same swath or kerf or groove. As illustrated, all the cutting elements 43 and 43' on fixed-blade cutter 27 and cutting elements 37 and 37' on rolling cutter 33 have the same exposure to cut the same depth of formation for an equal cut of the formation during a revolution of the hybrid drill bit 11, although this may be varied as desired. Further illustrated in FIG. 3C in broken lines, backup cutters 53 on third fixed-blade cutter 27 located behind cutting elements 43 may have the same exposure of cut as cutting elements 43 or less exposure of cut as cutting elements 43 and have the same diameter or a smaller diameter than a cutting element 43. Additionally, backup cutters 53 while cutting in the same swath or kerf or groove as a cutting element 43 may be located off the center of a cutting element 43 associated therewith. In this manner, cutting elements 43 and backup cutters 53 on third fixed-blade cutter 27 and cutting elements 37 on third rolling cutter 33 will all cut in the same swath or kerf or groove while being either centered on each other or slightly off-centered from each other having the same exposure of cut or, in the alternative, a lesser exposure of cut.

Figure 3D:
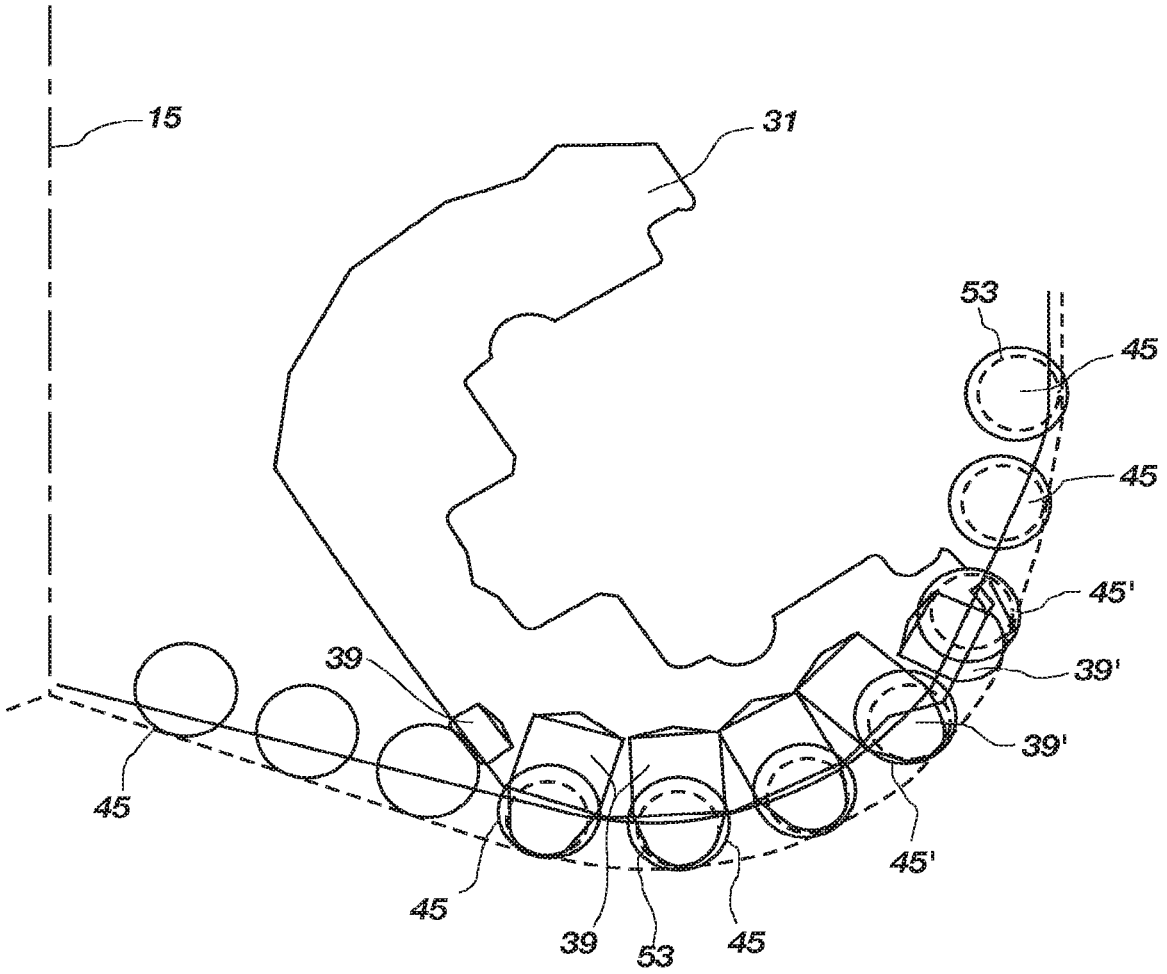
FIG. 3D is a view of cutting elements of a third fixed-blade cutter and cutting elements of a third rolling cutter of an embodiment of a hybrid bit of the present invention.

Illustrated in FIG. 3D is a cutting profile for the fixed cutting elements 45 on second fixed-blade cutter 25 in relation to cutting elements 39 on second rolling cutter 31 forming a pair of cutters on hybrid bit 11. As illustrated, some of the cutting elements 45 on second fixed-blade cutter 25 and cutting elements 39 on second rolling cutter 31 both have the same center and cutting in the same swath or kerf or groove while other cutting elements 45' on fixed-blade cutter 25 and cutting elements 39' on rolling cutter 31 do not have the same center but cut in the same swath or kerf or groove. As illustrated, all the cutting elements 45 and 45' on fixed-blade cutter 25 and cutting elements 39 and 39' on rolling cutter 33 have the same exposure to cut the same depth of formation for an equal cut of the formation, although this may be varied as desired. As illustrated, all the cutting elements 45 and 45' on fixed-blade cutter 25 and cutting elements 39 and 39' on rolling cutter 31 have the same exposure to cut the same depth of formation for an equal cut of the formation during a revolution of the hybrid drill bit 11. Further illustrated in FIG. 3D in broken lines, backup cutters 53 on second fixed-blade cutter 25 located behind cutting elements 45 may have the same exposure of cut as cutting elements 45 or less exposure of cut as cutting elements 45 and have the same diameter or a smaller diameter than a cutting element 45. Additionally, backup cutters 53 while cutting in the same swath or kerf or groove as a cutting element 45 may be located off the center of a cutting element 45 associated therewith. In this manner, cutting elements 45 and backup cutters 53 on second fixed-blade cutter 25 and cutting elements 39 on second rolling cutter 31 will all cut in the same swath or kerf or groove while being either centered on each other or slightly off-centered from each other having the same exposure of cut or, in the alternative, a lesser exposure of cut.

When considering a pair of cutters of the hybrid bit 11 including a rolling cutter and a fixed-blade cutter, each having cutting elements thereon, having the same exposure of cut, and located at the same radial location from the axial center of the hybrid bit 11 cutting the same swath or kerf or groove, adjusting the angular spacing between rolling cutters 29, 31, 33, and fixed-blade cutters 23, 25, 27 is one way in which to adjust the cutting aggressiveness or aggressiveness of a hybrid bit 11 according to the present invention. When considering a pair of cutters having cutting elements thereon having the same exposure of cut and located at the same radial location from the axial centerline 15 of the hybrid bit 11 cutting the same swath or kerf or groove on the hybrid bit 11, the closer a rolling cutter 29 is to a first fixed-blade cutter 23 of the pair of cutters of the hybrid bit 11, the rolling cutter 29 is the primary cutter of the pair with the first fixed-blade cutter 23 cutting less of the pair. Spacing a rolling cutter 29 closer to a first fixed-blade cutter 23 of a pair of cutters on the hybrid bit 11 causes the rolling cutter 29 to have a more dominate cutting action of the pair of cutters thereby causing the hybrid bit 11 to have less cutting aggressiveness or aggressiveness. Spacing a rolling cutter 29 farther away from a first fixed-blade cutter 23 of a pair of cutters on the hybrid bit 11 allows or causes the cutting elements of the first fixed-blade cutter 23 to dominate the cutting action of the pair of cutters thereby increasing the cutting aggressiveness or aggressiveness of the hybrid bit 11.

Another way of altering the cutting aggressiveness of a hybrid bit 11 is by having a rolling cutter to lead a trailing fixed-blade cutter of a pair of cutters (including one of each type of cutter) or to have a fixed-blade cutter lead a trailing rolling cutter of a pair of cutters (including one of each type of cutter). As illustrated in drawing FIG. 1, when a fixed-blade cutter leads a rolling cutter of a pair of cutters of a hybrid bit 11 (see line HBLC), the hybrid bit 11 has more cutting aggressiveness cutting more like a fixed-blade cutter polycrystalline diamond (PDC) bit. As illustrated in FIG. 1, when a rolling cutter leads a fixed-blade cutter of a pair of cutters of a hybrid bit 11 (see line HCLB), the aggressiveness decreases with the hybrid bit having aggressiveness more like a rolling-cutter (roller-cone) bit.

Figure 3E:
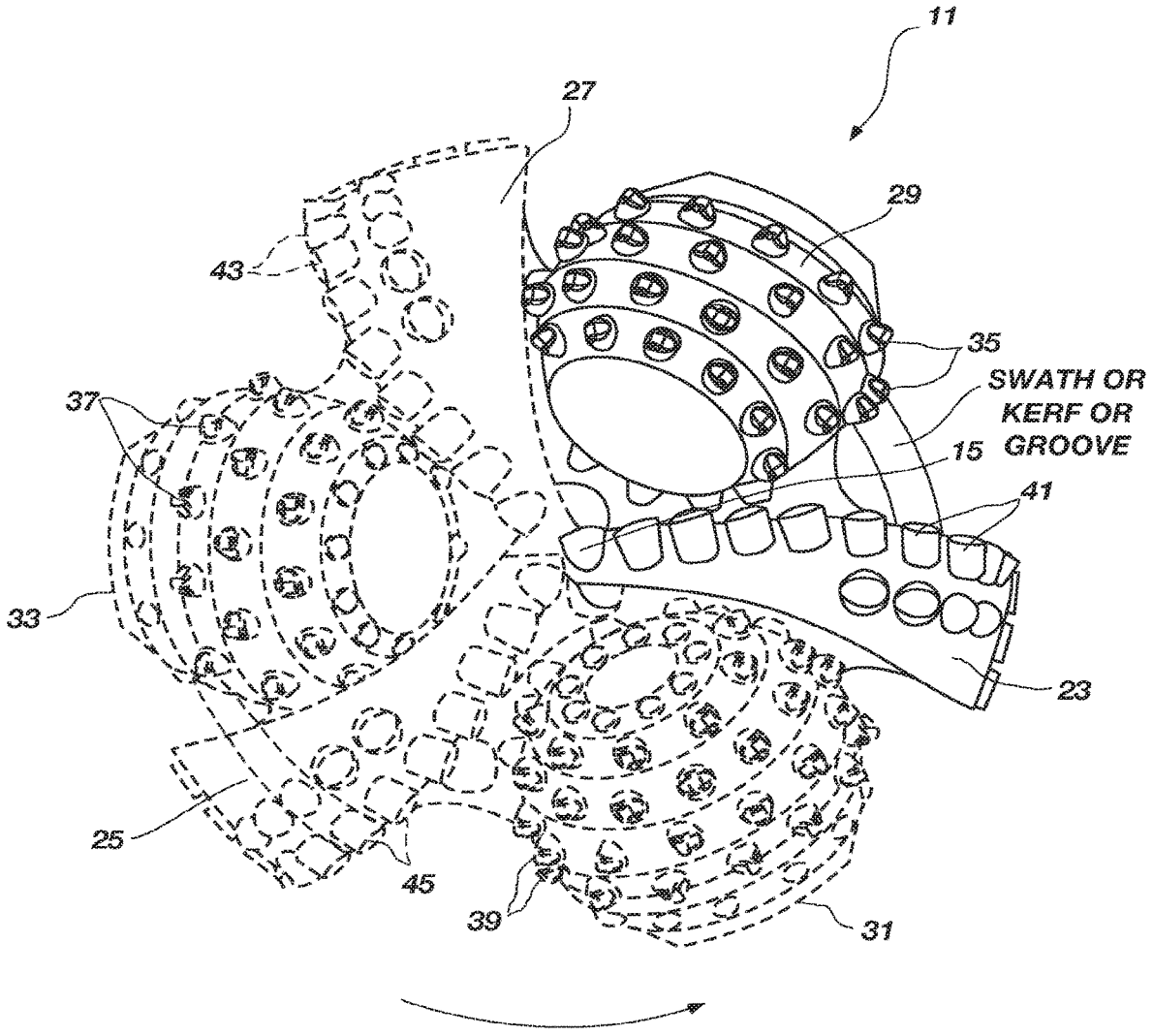
FIG. 3E is a view of FIG. 3 showing a pair of a rolling cutter and a fixed-blade cutter of a hybrid bit of FIG. 3 of the present invention.
Figure 3F:
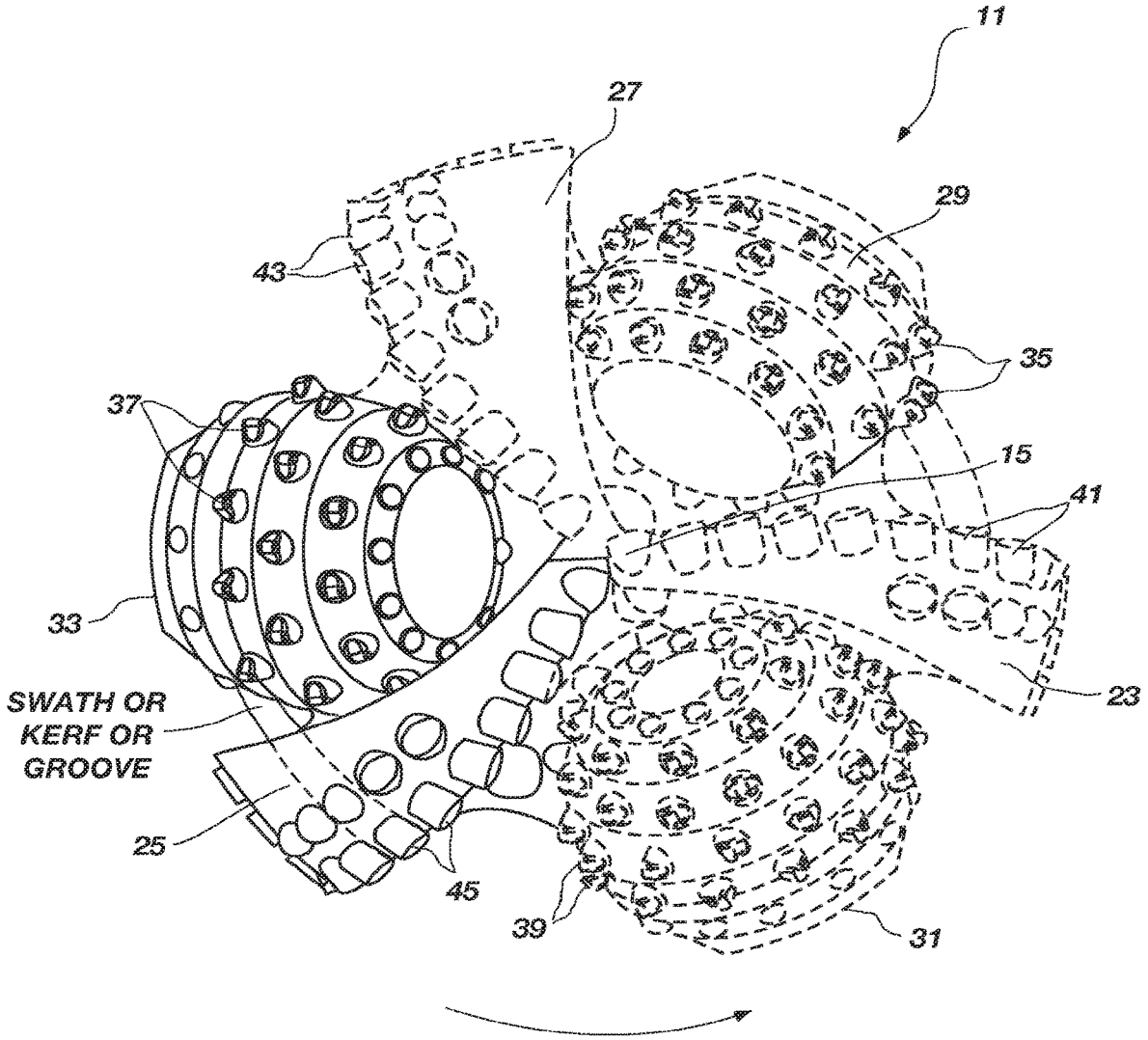
FIG. 3F is a view of FIG. 3 showing another fixed-blade cutter and another rolling cutter of a hybrid bit of FIG. 3 of the present invention.

In the illustrated hybrid bit 11 of FIG. 3E, for the purposes of illustrating different embodiments of the present invention, one rolling cutter 29 "leads" its trailing fixed-blade cutter 23 as a pair of cutters. As illustrated in FIG. 3F as another embodiment of the present invention, one second fixed-blade cutter 25 "leads" its trailing rolling cutter 33 as a pair of cutters. By "leads" it is meant that the cutting elements on the adjacent, trailing structure (whether fixed-blade cutter or rolling cutter) are arranged to fall in the same swath or kerf or groove as that made by the cutting elements on the leading structure (whether a fixed-blade cutter or rolling cutter), as indicated by phantom lines in FIG. 3E or FIG. 3F. Thus, the cutting elements 41 on first fixed-blade cutter 23 fall in the same swath or kerf or groove (see FIG. 3A, FIG. 3B) as the cutting elements 35 on rolling cutter 29. Similarly, the cutting elements 37 on third rolling cutter 33 fall in the same swath or kerf or groove (see FIG. 3A, FIG. 3C) as cutting elements 45 on second fixed-blade cutter 25. When a rolling cutter leads a trailing fixed-blade cutter, cutting aggressiveness or aggressiveness of the hybrid bit 11 is decreased. Conversely, when a fixed-blade cutter leads a trailing rolling cutter, cutting aggressiveness or aggressiveness of the hybrid bit 11 is increased. Such is illustrated in FIG. 1 in the broken lines labeled HCLB and HBLC therein.

Also, in the embodiment of FIG. 3, rolling cutter 31 has its cutting elements 39 arranged to lead the cutting elements 43 on the opposing (if not directly opposite, i.e., 180 degrees) third fixed-blade cutter 27. Thus, being angularly spaced-apart approximately 180 degrees on the hybrid bit 11, third fixed-blade cutter 27 and second rolling cutter 31 bear load approximately equally on the hybrid bit 11. In most cases, where there are an equal number of fixed-blade cutters and rolling cutters, each fixed-blade cutter should be "paired" with a rolling cutter such that the cutting elements on the paired fixed-blade cutter and rolling cutter fall in the same swath or kerf or groove when drilling a formation. All rolling cutters can lead all fixed-blade cutters, making a less aggressive bit (see solid line HCLB in FIG. 1); or all fixed-blade cutters can lead all rolling cutters, making a more aggressive bit (see broken line HBLC in FIG. 1), or all the cutting elements of a rolling cutter can fall in the same swath or kerf or groove as the cutting elements on an opposing fixed blade (see broken line HCOB in FIG. 1), or any combination thereof on a hybrid bit of the present invention.

FIG. 4 illustrates an embodiment of the earth-boring hybrid bit 111 according to the present invention that is similar to the embodiments of FIG. 3 in all respects, except that cutting elements 135, 137, 139 on each of the rolling cutters 129, 133, 131, respectively, are arranged to cut in the same swath or kerf or groove as the cutting elements 145, 141, 143 on the opposite or opposing fixed-blade cutters 125, 123, 127, respectively. Thus, the cutting elements 135 on rolling cutter 129 fall in the same swath or kerf or groove as the cutting elements 145 on the opposing fixed-blade cutter 125. The same is true for the cutting elements 139 on rolling cutter 131 and the cutting elements 143 on the opposing fixed-blade cutter 127; and the cutting elements 137 on rolling cutter 133 and the cutting elements 141 on opposing fixed-blade cutter 123. This can be called a "cutter-opposite" arrangement of cutting elements. In such an arrangement, rather than the cutting elements on a fixed-blade cutter or rolling cutter "leading" the cutting elements on a trailing rolling cutter or fixed-blade cutter, the cutting elements on a fixed-blade cutter or rolling cutter "oppose" those on the opposing or opposite rolling cutter or fixed-blade cutter.

The hybrid bit 111 of FIG. 4, having the "cutter-opposite" configuration of pairs of cutters, appears to be extremely stable in comparison to all configurations of "cutter-leading" pairs of cutters or all "blade-leading" pairs of cutters. Additionally, based on preliminary testing, the hybrid bit 111 of FIG. 4 out drills a conventional rolling-cutter bit and a conventional fixed-blade cutter bit having polycrystalline diamond cutting elements (PDC bit), as well as other hybrid bit configurations ("cutter-leading") in hard sandstone. For example, a conventional 12¼-inch rolling-cutter bit drills the hard sandstone at 11 feet/hour, a conventional fixed-blade cutter bit having polycrystalline diamond cutting elements (PDC bit) at 13 feet/hour, the hybrid bit with a "cutter-leading" pair of cutters configuration at 14 feet/hour and the hybrid bit with a "cutter-opposite" pair of cutters configuration at 21 feet/hour. Different types of hard sandstone is the material that are most difficult formations to drill using fixed-blade cutter bits mainly due to high levels of scatter vibrations. In that particular application, the balanced loading resulting from the "cutter-opposite" pair of cutters configuration of a hybrid bit is believed to produce a significant difference over other types and configurations of bits. In softer formations (soft and medium-hard), it is believed that the more aggressive "blade-leading" pair of cutter hybrid bit configurations will result in the best penetration rate. In any event, according to the preferred embodiment of the present invention, the aggressiveness of a hybrid bit can be tailored or varied to the particular drilling and formation conditions encountered.

Still another way to adjust or vary the aggressiveness of the hybrid bit 11 is to arrange the cutting elements 35, 37, 39 on the rolling cutters 29, 31, 33 so that they project deeper into the formation being drilled than the cutting elements 41, 43, 45 on the fixed-blade cutters 23, 25, 27. The simplest way to do this is to adjust the projection of some or all of the cutting elements 35, 37, 39 on the rolling cutters 29, 31, 33 from the surface of each rolling cutter 29, 31, 33 so that they project in the axial direction (parallel to the bit central axis or centerline 15) further than some or all of the cutting elements 41, 43, 45 on fixed-blades cutters 23, 25, 27. In theory, the extra axial projection of a cutting element of the cutting elements on the rolling cutters causes the cutting element to bear more load and protects an associated cutting element of the fixed-blade cutter.

Figure 5:
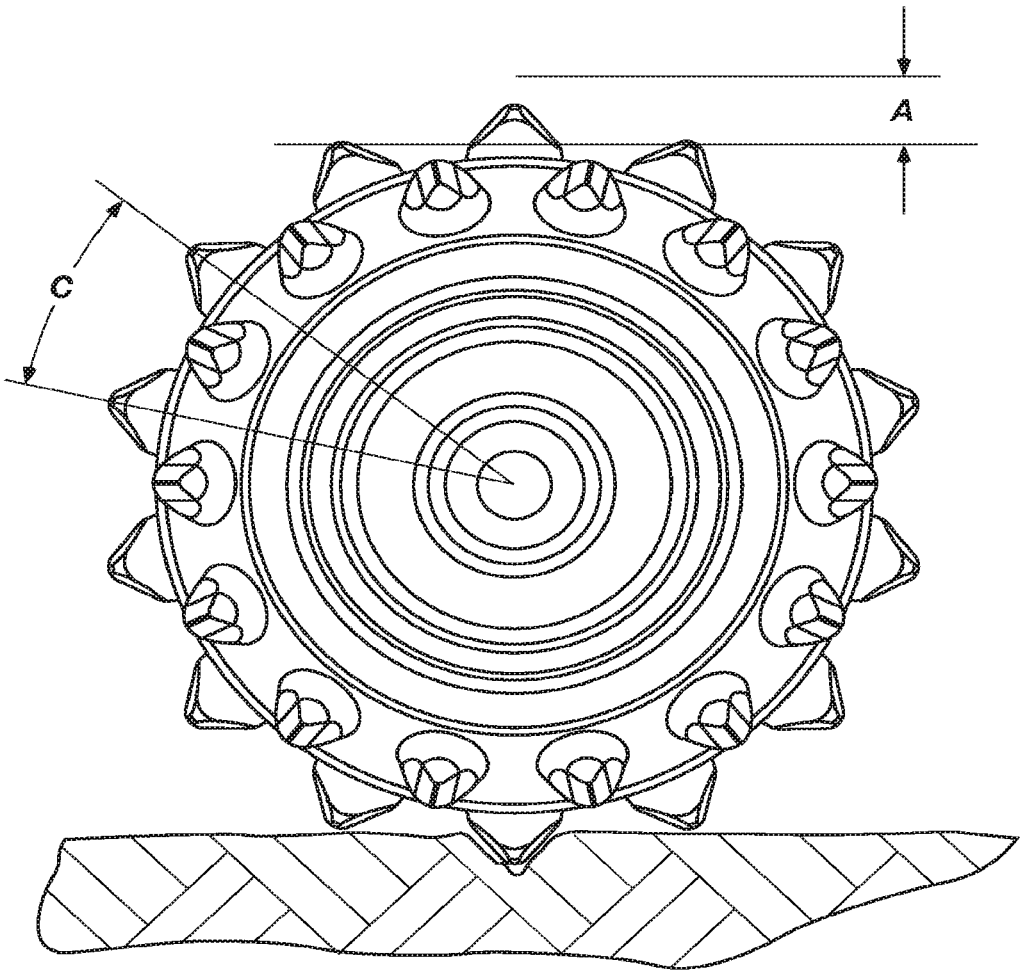
FIGS. 5 and 6 are partial schematic views of rolling cutters and cutting elements of rolling cutters interfacing with the formation being drilled.
Figure 6:
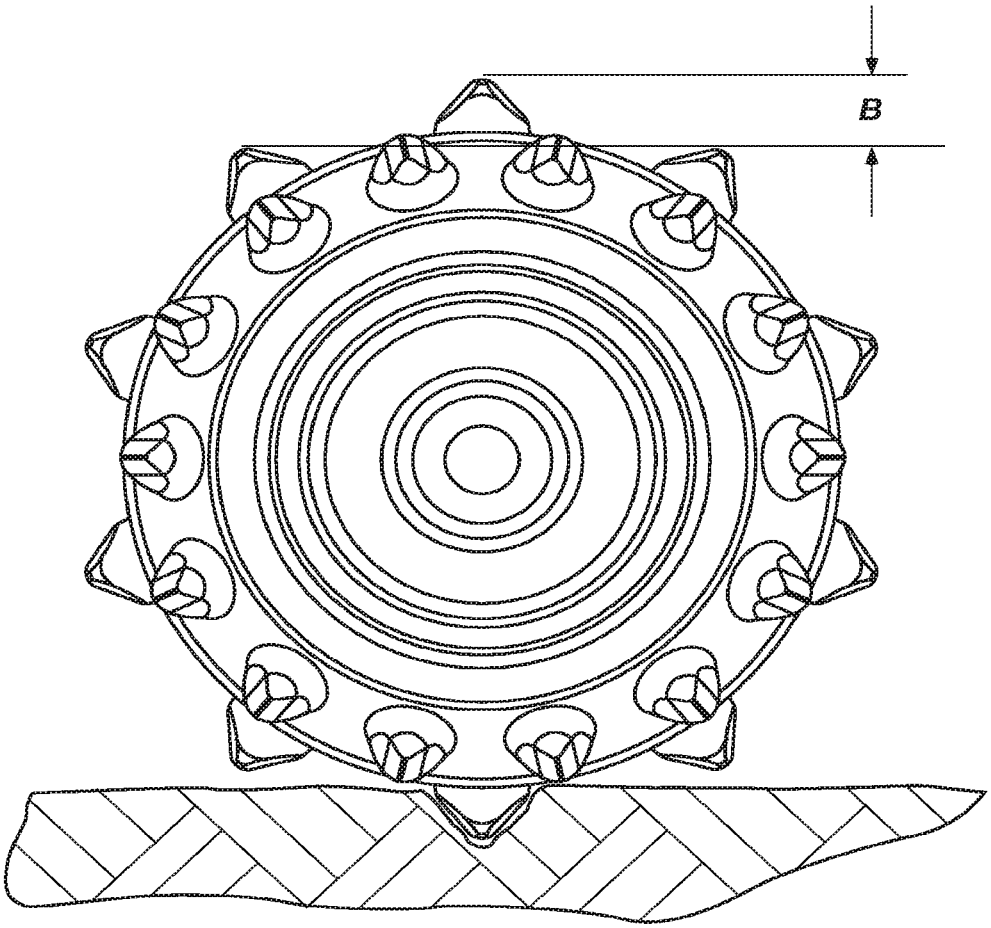

In practice, it is a combination of the projection of each cutting element of a rolling cutter from the surface of its rolling cutter, combined with its angular spacing (pitch) from adjacent cutting elements that governs whether the cutting elements of a rolling cutter actually bear more of the cutting load than an associated cutting element on a fixed-blade cutter. This combination is referred to herein as "effective projection," and is illustrated in FIGS. 5 and 6. As shown in FIG. 5, the effective projection A of a given cutting element of a rolling cutter, or that projection of the cutting element available to penetrate into earthen formation, is limited by the projection of each adjacent cutting element and the angular distance or pitch C between the adjacent cutting elements and the given cutting element. FIG. 6 illustrates "full" effective projection B in that the pitch is selected so that the adjacent cutting elements on either side of a given cutting element permit penetration of the cutting element to a depth equal to its full projection from the surface of a rolling cutter.

From the exemplary embodiment described above, a method for designing a hybrid earth-boring bit of the present invention permits or allows the cutting aggressiveness of a hybrid bit to be adjusted or selected based on the relationship of at least a pair of cutters comprising a fixed-blade cutter and a rolling cutter, of a plurality of fixed-blade cutters and rolling cutters, wherein the relationship includes a fixed-blade cutter leading a rolling cutter in a pair of cutters, a rolling cutter leading a fixed-blade cutter in a pair of cutters, a rolling cutter being located opposite a fixed-blade cutter in a pair of cutters on the bit, and the angular relationship of a fixed-blade cutter and a rolling cutter of a pair of cutters regarding the amount of leading or trailing of the cutter from an associated cutter of the pair of cutters. The cutting aggressiveness of a hybrid bit of the present invention being achieved by defining a cutting aggressiveness of a hybrid drill bit and the various combinations of pair of a fixed-blade cutter and a rolling cutter, when compared to each other and to different types of drill bits, such as a rolling-cutter drill bit and a fixed-blade cutter drill bit, either as the ratio of torque to weight-on-bit or as the ratio of penetration rate to weight-on-bit. The cutting aggressiveness for a hybrid bit of the present invention being adjusted by performing at least one of the following steps:

adjusting the angular distance between each rolling cutter and each fixed-blade cutter of a pair of cutters of the bit;

adjusting the effective projection of the cutting elements on a rolling cutter;

arranging the cutting elements of a fixed blade and the cutting elements of a rolling cutter so that at least one cutting element of a rolling cutter and at least one cutting element of a fixed blade cut the same swath or kerf or groove during a drilling operation; and arranging a pair of at least one fixed-blade cutter and a rolling cutter so that the rolling cutter either leads the fixed-blade cutter) [(<180°) angular distance], the rolling cutter opposes the fixed-blade cutter [(=180°) angular distance], or trails the fixed-blade cutter [(>180°) angular distance].

As described above, decreasing the angular distance between a leading rolling cutter and fixed-blade cutter decreases aggressiveness of the pair of cutters, while increasing the distance therebetween increases aggressiveness of the pair of cutters. Increasing the effective projection on cutting elements of a rolling cutter by taking into account the pitch between them increases the aggressiveness and the converse is true. Finally, designing the cutting elements on a fixed blade to lead the cutting elements on the trailing rolling cutter increases aggressiveness, while having a rolling cutter leading its trailing fixed-blade cutter has the opposite effect. According to this method, aggressiveness is increased, generally, by causing the scraping action of the cutting elements and fixed blades and to dominate over the crushing action of the cutting elements and the rolling cutters.

Increased aggressiveness is not always desirable because of the erratic torque responses that generally come along with it. The ability to tailor a hybrid bit to the particular application can be an invaluable tool to the bit designer.

The invention has been described with reference to preferred or illustrative embodiments thereof. It is thus not limited, but is susceptible to variation and modification without departing from the scope of the invention.

What is claimed is:

1. A hybrid bit, comprising:

a cutting profile extending from a cone region to a gage region of the hybrid bit;

a first rolling cutter assembly, a second rolling cutter assembly, and a third rolling cutter assembly, wherein each rolling cutter assembly of the first, second, and third rolling cutter assemblies is truncated in length and has a plurality of cutting elements configured to remove formation in nose and shoulder regions of the cutting profile, the first, second, and third rolling cutter assemblies establishing a rolling cutter aggressiveness for the hybrid bit; and a first fixed blade, a second fixed blade, and a third fixed blade, wherein each fixed blade of the first, second, and third fixed blades has a plurality of cutting elements configured to remove formation from at least the cone region adjacent a centerline of the hybrid bit, the first, second, and third fixed blades establishing a fixed blade aggressiveness for the hybrid bit, wherein at least one cutting element of the plurality on one of the first, second, and third fixed blades and at least one cutting element of the plurality on one of the first, second, and third rolling cutter assemblies are aligned to cut a same swath, wherein the first rolling cutter assembly and the first fixed blade are spaced apart by a first angular distance and the second rolling cutter assembly and the second fixed blade are spaced apart by a second angular distance, the first angular distance being different from the second angular distance, wherein the third rolling cutter assembly is angularly spaced apart from the third fixed blade by a third angular distance, the third angular distance being different from the first angular distance and the second angular distance, and wherein a bit aggressiveness of the hybrid bit is predetermined as a function of the rolling cutter aggressiveness and the fixed blade aggressiveness.

2. The hybrid bit of claim 1, wherein the bit aggressiveness is predetermined based at least partially on a predetermined angular distance between the first rolling cutter assembly and the first fixed blade.

3. The hybrid bit of claim 1, wherein a projection of the at least one cutting element on the first rolling cutter assembly is the same as a projection of the at least one cutting element on the first fixed blade.

4. The hybrid bit of claim 1, wherein the first fixed blade leads the first rolling cutter assembly to increase the bit aggressiveness.

5. The hybrid bit of claim 1, wherein the first fixed blade trails the first rolling cutter assembly to decrease the bit aggressiveness.

6. The hybrid bit of claim 1, wherein a means for establishing a predetermined bit aggressiveness comprises a predetermined angular distance between at least one of first and second rolling cutter assemblies and at least one of the first and second fixed blades.

7. The hybrid bit of claim 1, wherein the bit aggressiveness is predetermined based at least partially on an effective projection of one or more of the plurality of cutting elements on at least one of the first, second, or third rolling cutter assemblies.

8. The hybrid bit of claim 1, wherein the at least one of the first, second, or third fixed blades leads at least one of the first, second, or third rolling cutter assemblies to increase the bit aggressiveness.

9. The hybrid bit of claim 1, wherein at least one of the first, second, or third fixed blades trails at least one of the first, second, or third rolling cutter assemblies to decrease the bit aggressiveness.

10. The hybrid bit of claim 1, wherein the first rolling cutter assembly is angularly spaced about 120 degrees apart from the second rolling cutter assembly.

11. The hybrid bit of claim 1, wherein the first fixed blade is angularly spaced about 180 degrees apart from the first rolling cutter assembly.

12. A method of drilling subterranean formations, comprising:

drilling with a first bit comprising:

a first fixed blade, a second fixed blade, and a third fixed blade, wherein at least one of the fixed blades of the first, second, or third fixed blades has a first row of cutting elements arranged on a leading edge and configured to remove formation in cone, nose, and shoulder regions;

a first truncated rolling cutter assembly, a second truncated rolling cutter assembly, and a third truncated rolling cutter assembly, wherein at least one of the truncated rolling cutter assemblies of the first, second, or third truncated rolling cutter assemblies has a plurality of rows of cutting elements configured to remove formation in at least the shoulder region, but not in the cone region; and wherein the first truncated rolling cutter assembly and the first fixed blade are spaced apart by a first angular distance and the second truncated rolling cutter assembly and the second fixed blade are spaced apart by a second angular distance, the first angular distance being different from the second angular distance, wherein the third truncated rolling cutter assembly is angularly spaced apart from the third fixed blade by a third angular distance, the third angular distance being different from the first angular distance and the second angular distance, and;

determining aggressiveness of drilling with the first bit as a function of rate of formation penetration and weight-on-bit; and thereafter; and varying the aggressiveness of drilling by:

drilling with another bit having an angular displacement between a truncated rolling cutter and a fixed blade cutter that is different than an angular displacement of first bit; or drilling with another bit having an effective projection between at least two adjacent cutting elements on a truncated rolling cutter that is different than an effective projection between adjacent cutting elements of at least one truncated rolling cutter assembly of the first bit; or drilling with another bit in which cutting elements on a rolling cutter lead cutting elements on a fixed blade more than on the first bit; or drilling with another bit in which cutting elements on a fixed blade lead cutting elements on a rolling cutter more than on the first bit; or drilling with another bit having cutting elements on opposing at least one fixed blade and cutting elements on at least one truncated rolling cutter such that the cutting elements track in the same kerf.

13. The method of claim 12, wherein the first bit further comprises a first cutting element and a second cutting element attached to the at least one truncated rolling cutter assembly of the first truncated rolling cutter assembly, a second truncated rolling cutter assembly, or a third truncated rolling cutter assembly are configured such that only one of the first cutting element and the second cutting element engages independently during drilling.

14. The method of claim 13, wherein at least one of the first fixed blade, the second fixed blade, or the third fixed blade of the first bit further comprises at least one row of back cutters aligned to cut formation in a same swath as cut by the first row of cutting elements.

15. The method of claim 12, wherein the first truncated rolling cutter assembly and the second truncated rolling cutter assembly of the first bit are angularly spaced about 120 degrees apart.

16. The method of claim 12, wherein the first bit comprises an equal number of fixed blades and truncated rolling cutter assemblies.

* * * * *